US008974360B2

(12) United States Patent
Musha

(10) Patent No.: US 8,974,360 B2
(45) Date of Patent: Mar. 10, 2015

(54) CREASING DEVICE, IMAGE FORMING SYSTEM, AND CREASING METHOD

(75) Inventor: Akihiro Musha, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 907 days.

(21) Appl. No.: 13/067,875

(22) Filed: Jul. 1, 2011

(65) Prior Publication Data

US 2012/0021884 A1 Jan. 26, 2012

(30) Foreign Application Priority Data

Jul. 23, 2010 (JP) ..... 2010-166369
Jan. 27, 2011 (JP) ..... 2011-015419

(51) Int. Cl.
*B31B 1/26* (2006.01)
*B65H 45/12* (2006.01)
*B31F 1/10* (2006.01)

(52) U.S. Cl.
CPC *B31F 1/10* (2013.01); *B65H 45/12* (2013.01); *B65H 2511/415* (2013.01); *B65H 2801/27* (2013.01)
USPC ..... 493/405; 493/23; 493/24; 270/58.07; 270/58.08

(58) Field of Classification Search
CPC ..... B65H 45/12; B65H 45/147; B41F 3/42
USPC ..... 493/405, 402, 424, 425, 434, 435, 436, 493/401, 403, 445, 444, 442, 23, 396, 397, 493/399; 270/4, 8, 58.07, 58.08; 399/45, 399/407, 408
See application file for complete search history.

(56) References Cited

U.S. PATENT DOCUMENTS

| | | | | |
|---|---|---|---|---|
| 6,929,256 | B2 * | 8/2005 | Kawatsu et al. | 270/37 |
| 7,626,735 | B2 * | 12/2009 | Mizuhashi et al. | 358/474 |
| 2006/0229184 | A1 * | 10/2006 | Powell | 493/467 |
| 2009/0062096 | A1 * | 3/2009 | Sasahara | 493/396 |
| 2009/0291814 | A1 * | 11/2009 | Garner et al. | 493/10 |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |

FOREIGN PATENT DOCUMENTS

| | | | |
|---|---|---|---|
| JP | 2008081258 | A | 4/2008 |
| JP | 2011057423 | A | 3/2011 |

* cited by examiner

*Primary Examiner* — Stephen F Gerrity
*Assistant Examiner* — Joy N Sanders
(74) *Attorney, Agent, or Firm* — Harness, Dickey & Pierce, P.L.C.

(57) ABSTRACT

A creasing device forms a crease in a to-be-folded portion of a sheet. The creasing device includes a sheet-information reading unit that reads any one of sheet information and binding information; a determining unit that determines a surface, on which the crease is to be formed, of the sheet according to the one of the sheet information and the binding information read by the sheet-information reading unit; and a creasing unit that forms the crease on the surface determined by the determining unit.

12 Claims, 19 Drawing Sheets

EXAMPLE: 12-PAGE BOOKLET

CREASING DEVICE, IMAGE FORMING SYSTEM, AND CREASING METHOD

CROSS-REFERENCE TO RELATED APPLICATIONS

The present application claims priority to and incorporates by reference the entire contents of Japanese Patent Application No. 2010-166369 filed in Japan on Jul. 23, 2010 and Japanese Patent Application No. 2011-015419 filed in Japan on Jan. 27, 2011.

BACKGROUND OF THE INVENTION

1. Field of the Invention

The present invention relates to creasing devices, image forming systems, and creasing methods. More specifically, the invention relates to a creasing device that makes a crease (a fold) on a sheet member (hereinafter, "sheet") delivered from a preceding stage before the sheet is folded in half, an image forming system including the creasing device, an image forming apparatus, and a sheet finisher that processes a sheet delivered from the image forming apparatus, and a creasing method for use by the creasing device or the image forming system.

2. Description of the Related Art

What is called saddle-stitched or center-folded booklet production has been conventionally performed. The saddle-stitched booklet production is performed by saddle stitching a sheet batch, which is a stack of a plurality of sheets delivered from an image forming apparatus, and folding the thus-saddle-stitched sheet batch in the middle of the sheet batch. Folding such a sheet batch containing a plurality of sheets can cause outer side sheets of the sheet batch to be stretched at a fold line by a greater amount than inner side sheets. Image portions at the fold line on outer side sheets can thus be stretched, resulting in damage, such as coming off of toner, to the image portions in some cases. A similar phenomenon can occur when other folds, such as a z-fold or a tri-fold, are performed. A sheet batch can be folded insufficiently depending on the thickness of the sheet batch.

A creasing device, called a creaser, that forms a crease in a sheet batch before the sheet batch undergoes half fold or the like folding operation so that even outer side sheets can be readily folded, thereby preventing coming off of toner has already been known.

An example of such a creasing device is disclosed in Japanese Patent Application Laid-open No. 2008-081258. The creasing device disclosed in Japanese Patent Application Laid-open No. 2008-081258 includes an annular protrusion provided along a perimeter of one roller for forming a crease and an annular concavity created along a perimeter of the other roller so that a pair of the rollers form a crease, having a precise and favorable shape according to a type of the sheet, that extends in a sheet-conveying direction on a sheet when the sheet passes through meshing between the annular protrusion and the annular concavity of the rollers. In the creasing device, the rollers are interchangeable with optimum rollers for a sheet to be creased.

Meanwhile, the creasing device disclosed in Japanese Patent Application Laid-open No. 2008-081258 includes the annular protrusion and the annular concavity provided on the perimeters of the paired rollers and forms a crease extending in a sheet conveying direction by causing the sheet to pass the meshing between the rollers. In this technique, in every sheet to be folded, a crease is formed in a to-be-folded portion from an outward side, which is to become an outer side when the sheet is folded, and then the crease is pushed by a push-out member from an inward side, which is to become an inner side when the sheet is folded, to prevent colorant from coming off the sheet. With this configuration, a folding position is likely to deviate from an intended position because the sheet is pushed out to an outward side. In terms of accuracy of folding position, a crease is preferably formed in a to-be-folded portion on an inward side, which allows accurate positioning of a fold. Put another way, importance has conventionally been placed on preventing coming off of colorant and no particular attention has been paid to accuracy in the positioning of the fold.

SUMMARY OF THE INVENTION

It is an object of the present invention to at least partially solve the problems in the conventional technology.

According to an aspect of the present invention, there is provided a creasing device that forms a crease in a to-be-folded portion of a sheet. The creasing device includes a sheet-information reading unit that reads any one of sheet information and binding information; a determining unit that determines a surface, on which the crease is to be formed, of the sheet according to the one of the sheet information and the binding information read by the sheet-information reading unit; and a creasing unit that forms the crease on the surface determined by the determining unit.

According to another aspect of the present invention, there is provided an image forming system including a creasing device that forms a crease in a to-be-folded portion of a sheet; a sheet-information reading unit that reads any one of sheet information and binding information; a determining unit that determines a surface, on which the crease is to be formed, of the sheet according to the one of the sheet information and the binding information read by the sheet-information reading unit; and a creasing unit that forms the crease on the surface determined by the determining unit.

According to still another aspect of the present invention, there is provided a creasing method for forming a crease in a to-be-folded portion of a sheet. The creasing method includes reading any one of sheet information and binding information; determining a sheet surface, on which the crease is to be formed, according to the one of the sheet information and the binding information read at the reading; and forming the crease in the surface determined at the determining.

The above and other objects, features, advantages and technical and industrial significance of this invention will be better understood by reading the following detailed description of presently preferred embodiments of the invention, when considered in connection with the accompanying drawings.

In the following embodiments, a sheet corresponds to a reference numeral P, a creasing device to a reference numeral 100, a sheet-information reading unit and a sheet-information reading process to step S201 (a process of a central processing unit), a determining unit and a determining process to steps S202 to S207 (processes of the CPU), a creasing unit to each elements and each units defined by a third unit or a fifth unit, respectively. A first rotary member corresponds to a reference numeral 121*b*, a second rotary member to a reference numeral 122*a*, a creasing member to creasing blades 121*c* and 122*b*, creasing grooves to 121*d* and 122*c*, rotary drive units to a second motor 135, a gear speed reduction mechanism 136, a third motor 139, a gear speed reduction mechanism 140, reciprocating drive unit to a first motor 131, a pulley speed-reduction mechanism 132 and a cam 134, respectively. A receiving member 122 corresponds to a reference numeral

122, a reversing mechanism to a sheet reversing mechanism 130, each branch of twofold forked sheet-conveying path to a first branch of sheet-conveying path 113*a* and a second branch of sheet-conveying path 113*b*, respectively. A rotary member that is arranged in a middle portion of the twofold forked sheet-conveying path corresponds to a reference numeral 121*e*, a pair of receiving members to reference numerals 122*ca* and 122*cb*, creasing processes to step 107, step S107*a*, step S107*b*, and step S210, respectively.

DETAILED DESCRIPTION OF THE PREFERRED EMBODIMENTS

Figure 1:
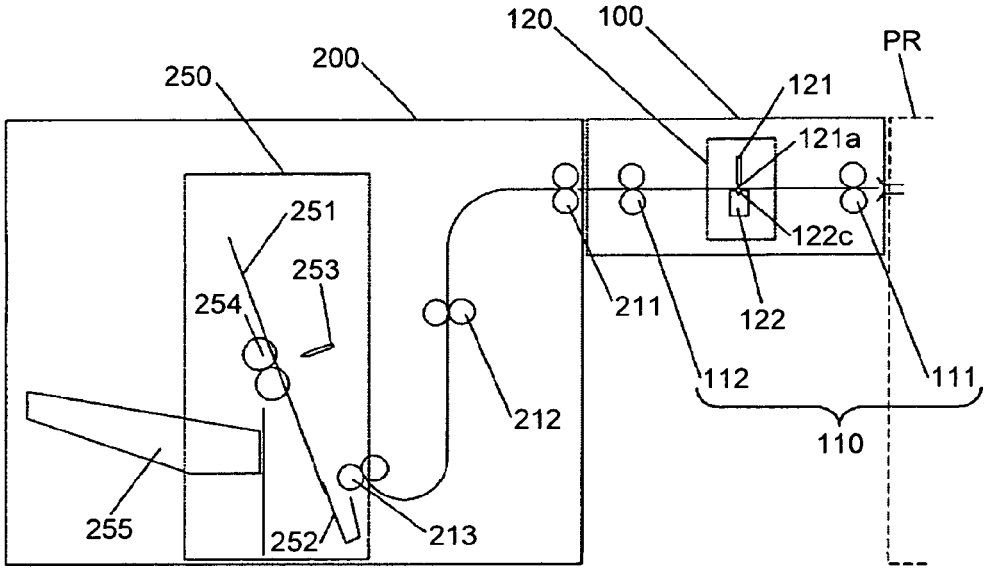
FIG. 1 is a diagram illustrating a schematic configuration of an image forming system according to an embodiment of the present invention.

Unlike typical creasing that is performed by forming a crease on an outward side of a to-be-folded portion of a sheet and then pushing the to-be-folded portion with a push-out member from an inward side toward rollers to prevent colorant from coming off an image, according to an aspect of the present invention, a surface, on which a crease is to be formed, is selectable. For a sheet, from which coming off of colorant should preferably be prevented, a crease is formed on an outward side of a to-be-folded portion to maintain image quality, while for a sheet, in which less importance is placed on image quality, a crease is formed on an inward side of the to-be-formed portion and the crease is pushed out from the inward side so that the sheet can be folded readily. This allows image quality to be maintained and reduces deviation of a folding position.

Exemplary embodiments of the present invention are described below with reference to the accompanying drawings. Identical or substantially identical elements are denoted by same reference numerals and symbols, and repeated descriptions are omitted.

FIG. 1 is a diagram illustrating a schematic configuration of an image forming system according to an embodiment of the present invention. The image forming system includes an image forming apparatus PR that forms an image on a sheet, a creasing device 100 that performs creasing, and a folding device 200 that performs folding.

The image forming apparatus PR forms a visible image pertaining to image data fed from a scanner, a personal computer (PC), or the like on a sheet of paper. The image forming apparatus PR uses a known print engine of electrophotography, droplet ejection printing, or the like.

The creasing device 100 includes a conveying mechanism 110 and a creasing mechanism 120. The creasing mechanism 120 includes a creasing member 121 and a receiving member 122, and forms a linear crease by pinching a sheet between the creasing member 121 and the receiving member 122. The creasing member 121 includes, on an end surface facing the receiving member 122, a creasing blade unit 121*a* for use in forming a crease. The creasing blade unit 121*a* extends linearly in a direction perpendicular to a sheet conveying direction and includes a pointed end, of which edge lies perpendicular to the sheet conveying direction. A creasing groove 122*c* is cut on a surface, which faces the creasing blade unit 121*a*, of the receiving member 122. The creasing groove 122*c* receives the creasing blade unit 121*a* that fits thereinto. The creasing member 121 and the receiving member 122 are shaped as described above; accordingly, when a sheet is pinched therebetween, the shape of the end of the blade and the shape of the groove leave a crease on the sheet.

In this example, the conveying mechanism includes a first pair of conveying rollers 111 and a second pair of conveying rollers 112 and conveys the sheet conveyed from the image forming apparatus PR to a subsequent stage.

The folding device 200 includes a center-folding device 250 that performs folding. The sheet creased by the creasing device 100 is delivered to the folding device 200, in which the sheet is conveyed by conveying rollers 211, conveying rollers 212, and conveying rollers 213 to the center-folding device 250.

The center-folding device 250 includes a center-folding tray 251, a trailing-edge fence 252 provided at a lower end (an upstream edge in the conveying direction) of the center-folding tray 251, a folding plate 253 and folding rollers 254 for folding the sheet along the crease, and a stacking tray 255. The trailing-edge fence 252 causes a return roller (not shown) to forcibly press trailing edges of sheets delivered onto the center-folding tray 251 against the trailing-edge fence 252, thereby aligning the sheets in the sheet conveying direction. A jogger fence (not shown) also aligns sheet edges in the direction perpendicular to the conveying direction.

The folding plate 253 presses its pointed end against and along the crease on the aligned sheet batch and pushes the crease into a nip of the folding rollers 254. The sheet batch pushed into the nip of the folding rollers 254 is creased in the nip. When the sheet batch is to undergo saddle-stitching, after the sheet batch is stitched by a stitching device (not shown) at a portion to be creased, the sheet batch is subjected to the folding operation, what is called as half fold, described above. The half-folded sheet batch is delivered onto and stacked on the stacking tray 255.

Figure 2:
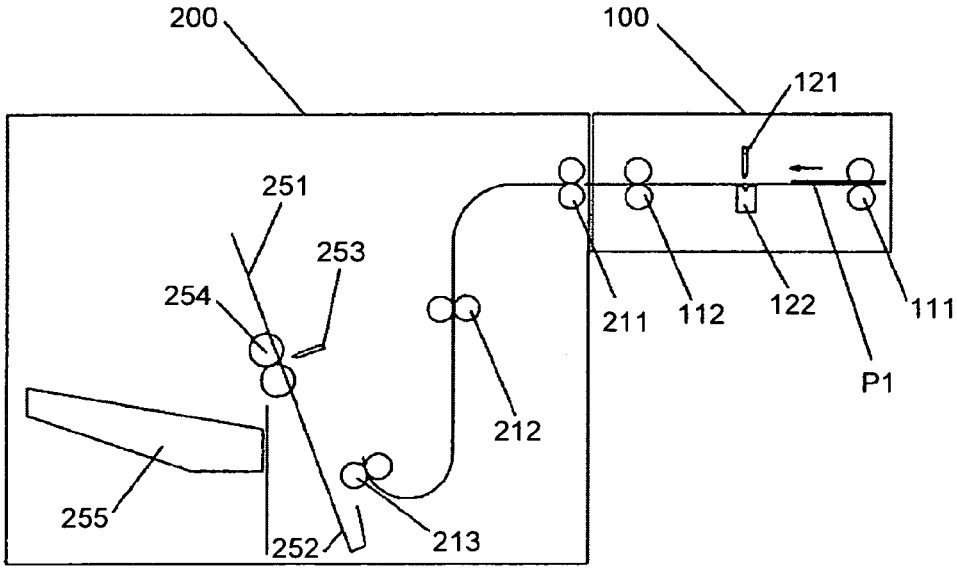
FIG. 2 is a schematic diagram illustrating how the image forming system performs operations, including creasing and folding, the diagram depicting a state in which a sheet is conveyed into a creasing device.
Figure 3:
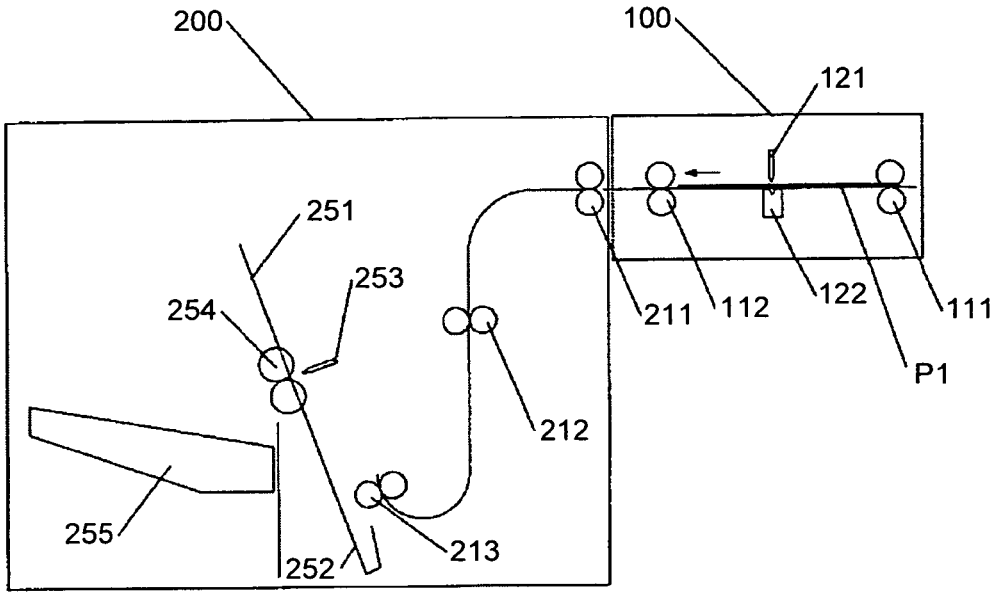
FIG. 3 is a schematic diagram illustrating how the image forming system performs the operations including creasing and folding, the diagram depicting a state in which a to-be-creased position of the sheet has reached a position where a creasing member is arranged.
Figure 4:
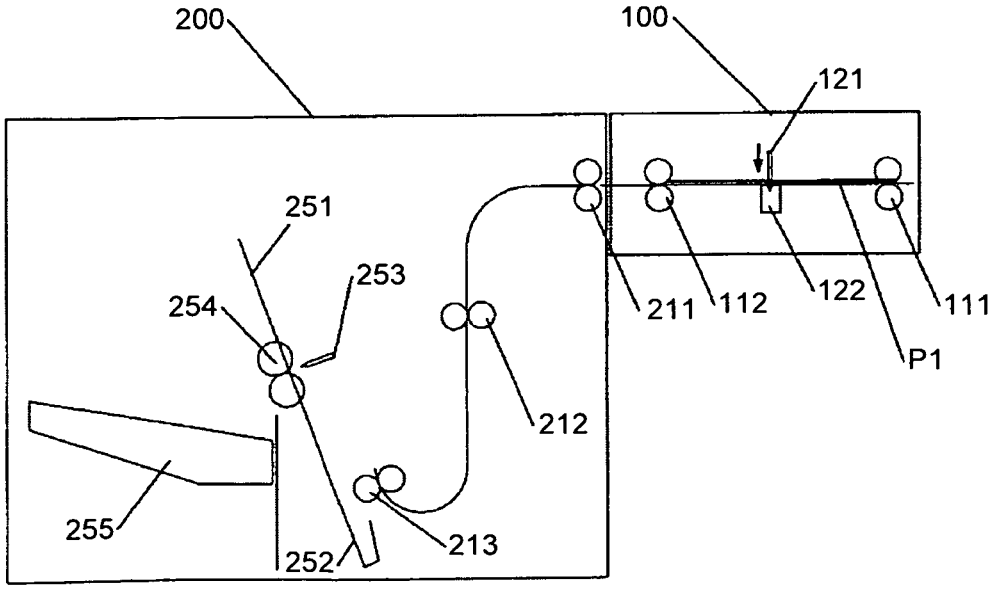
FIG. 4 is a schematic diagram illustrating how the image forming system performs the operations including creasing and folding, the diagram depicting a state in which creasing is being performed.
Figure 5:
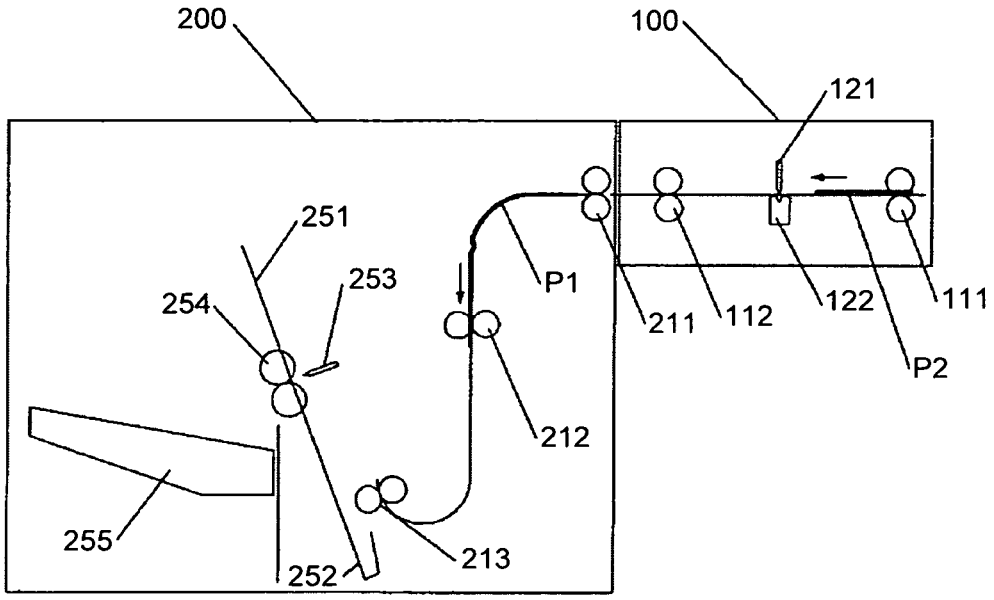
FIG. 5 is a schematic diagram illustrating how the image forming system performs the operations including creasing and folding, the diagram depicting a state in which a first sheet has been conveyed into a folding device and a second sheet has been conveyed into the creasing device.
Figure 6:
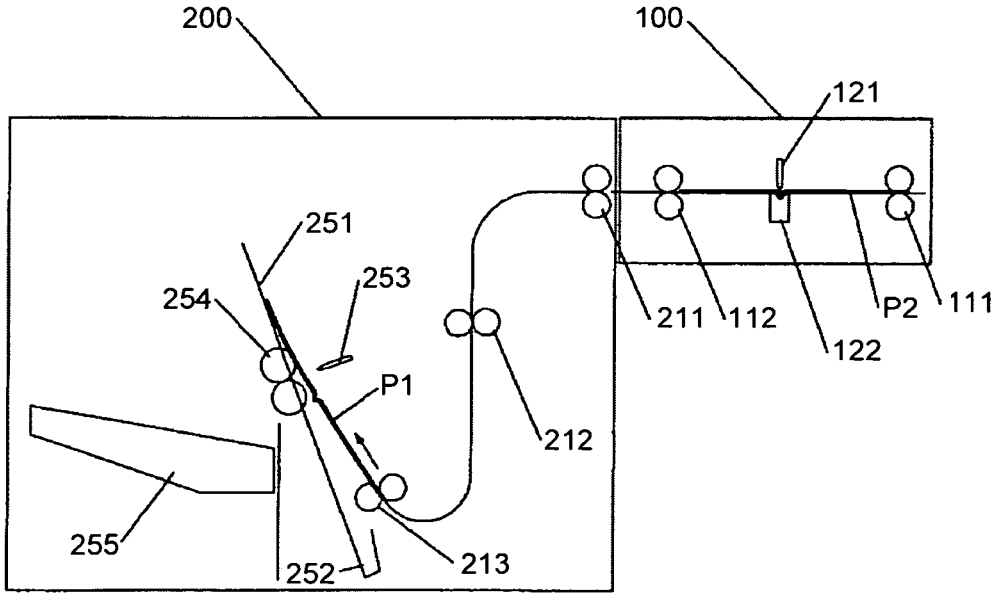
FIG. 6 is a schematic diagram illustrating how the image forming system performs the operations including creasing and folding, the diagram depicting a state in which the first sheet is immediately before being delivered onto a center-folding tray and the second sheet is being creased.

FIG. 2 to FIG. 12 are schematic diagrams illustrating a series of operations, including the folding operation described above, to be performed by the image forming system. In the image forming system, a sheet P1, on which an image has been formed by the image forming apparatus PR, is conveyed into the creasing device 100 and stopped at a position where a crease (a fold) is to be formed (FIG. 2 and FIG. 3). The first sheet P1 stopped at this position is pinched between the creasing member 121 and the receiving member 122; this forms a crease on the first sheet P1 (FIG. 4). Thereafter, the thus-creased sheet P1 is conveyed to the folding device 200 (FIG. 5) and temporarily stored in the center-folding tray 251 (FIG. 6).

Figure 7:
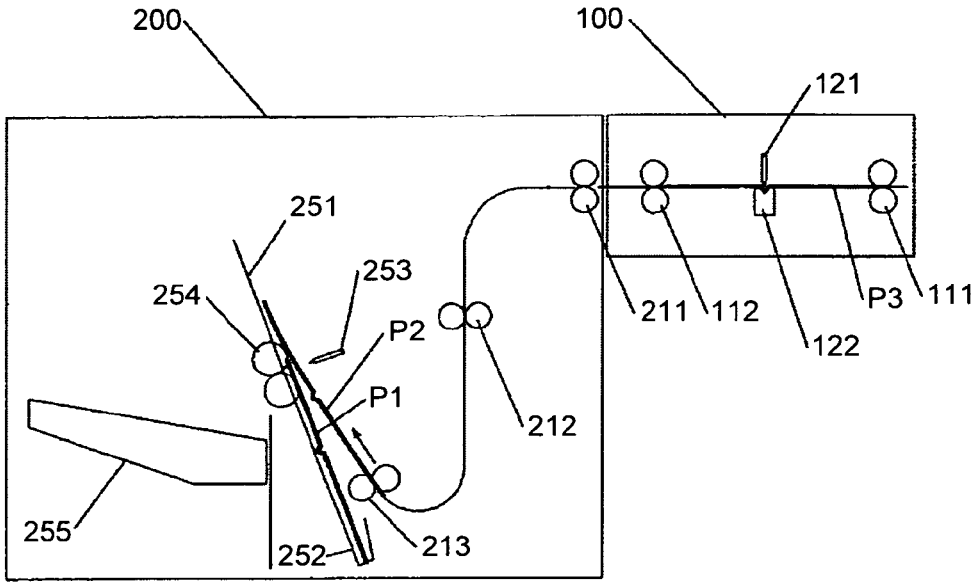
FIG. 7 is a schematic diagram illustrating how the image forming system performs the operations including creasing and folding, the diagram depicting a state in which the second sheet and a third sheet are processed as are the sheets illustrated in FIG. 6.
Figure 8:
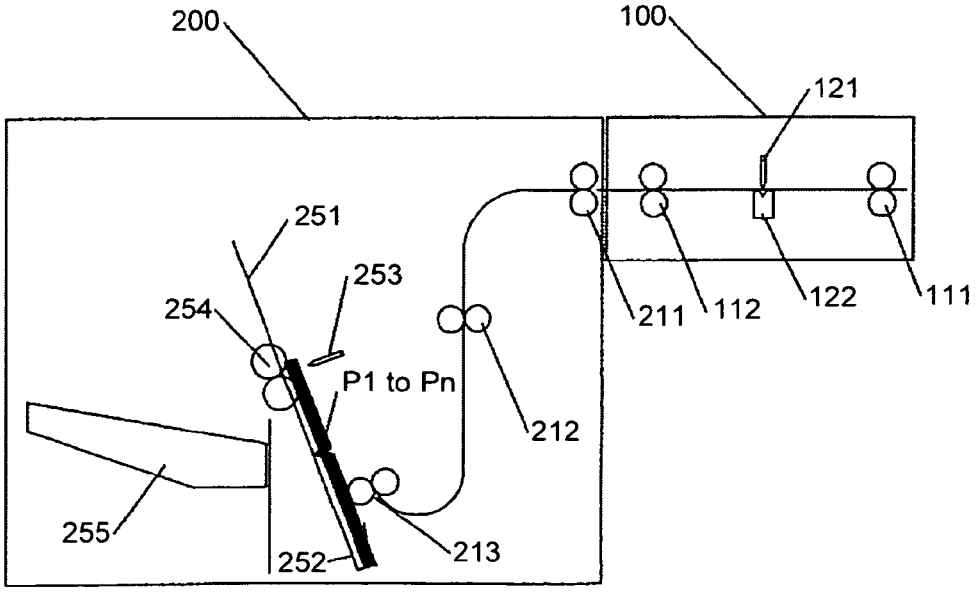
FIG. 8 is a schematic diagram illustrating how the image forming system performs the operations including creasing and folding, the diagram depicting a state in which all sheets belonging to one sheet batch have been delivered onto the center-folding tray.
Figure 9:
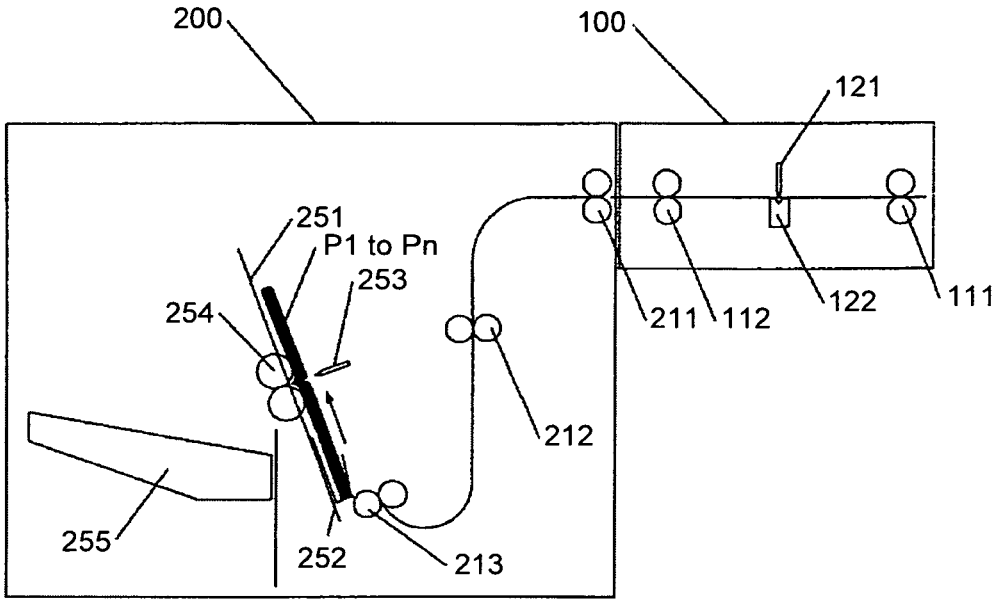
FIG. 9 is a schematic diagram illustrating how the image forming system performs the operations including creasing and folding, the diagram depicting a state in which the sheet batch on the center-folding tray is located at a center-folding position.
Figure 10:
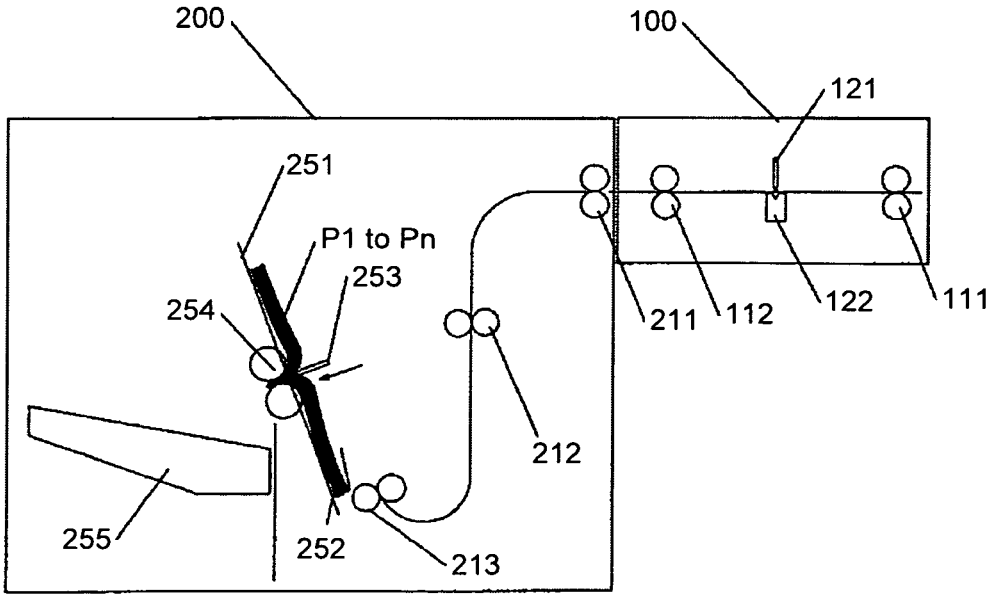
FIG. 10 is a schematic diagram illustrating how the image forming system performs the operations including creasing and folding, the diagram depicting a state in which center folding is started.
Figure 11:
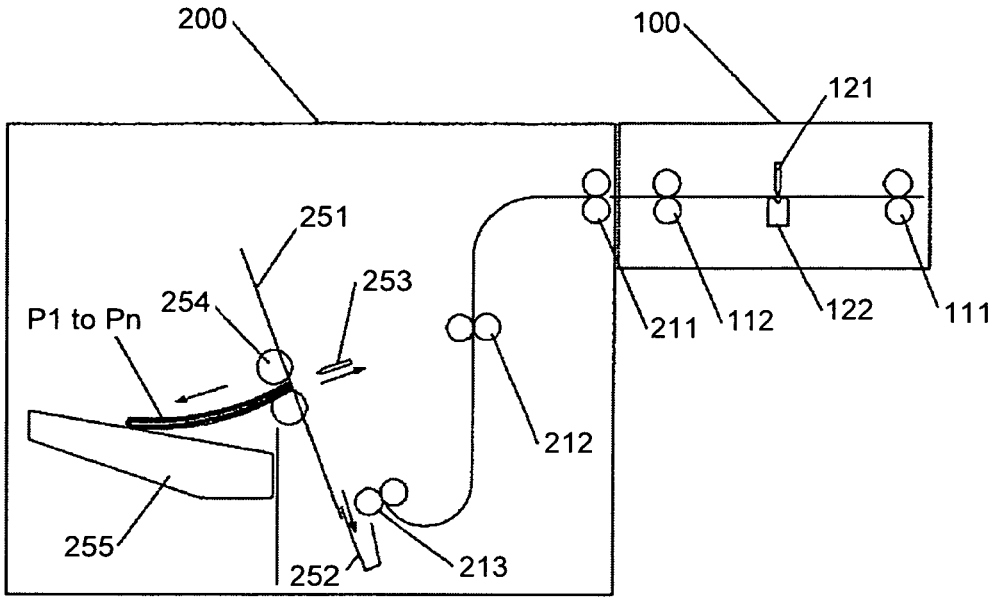
FIG. 11 is a schematic diagram illustrating how the image forming system performs the operations including creasing and folding, the diagram depicting a state in which the center-folded sheet batch is being delivered onto the stacking tray.
Figure 12:
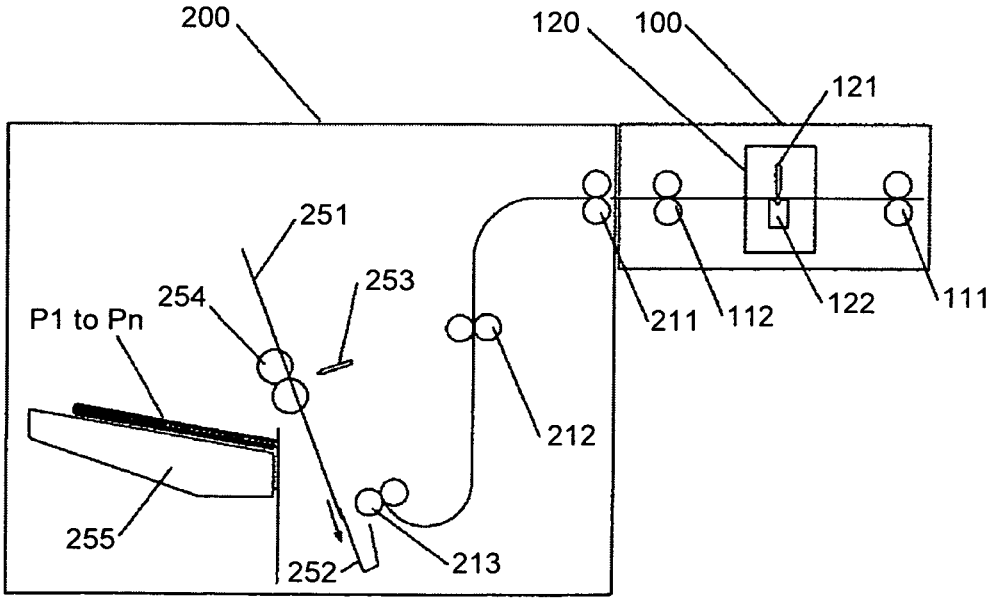
FIG. 12 is a schematic diagram illustrating how the image forming system performs the operations including creasing and folding, the diagram depicting a state in which the center-folded sheet batch has been delivered onto the stacking tray.

The operations mentioned above with reference to FIG. 2 to FIG. 6 are repeatedly performed for a predetermined number of sheets (FIG. 7). When a sheet batch (P1 to Pn) containing a predetermined number of sheets (P1 to Pn) has been stored in the center-folding tray 251 (FIG. 8), the trailing-edge fence 252 is moved (upward) to place the crease in the sheet batch at a folding position (FIG. 9). Thereafter, the folding plate 253 is pressed against the crease in the sheet batch to push the crease into the nip of a folding rollers 254, thereby performing folding (FIG. 10). The sheets folded into a booklet form are sequentially stacked on the stacking tray 255 (FIGS. 11 and 12).

Configurations and control operations of the creasing device according to each embodiment of the present invention are described below.

First Embodiment

Figure 13:
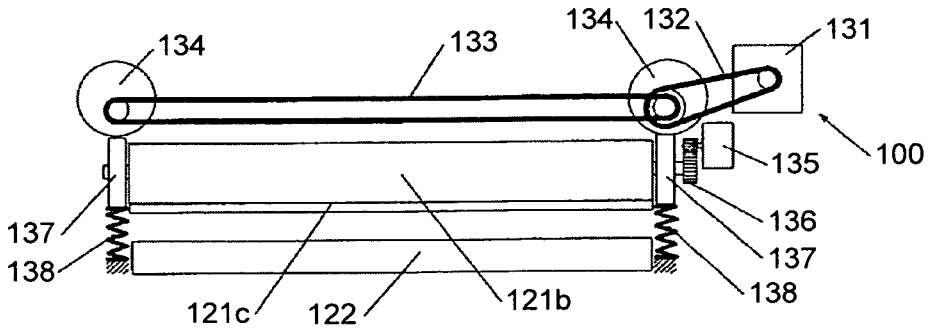
FIG. 13 is a diagram illustrating the configuration of a creasing device according to a first embodiment of the present invention, the diagram being an elevation view illustrating a standby state as viewed from a sheet conveying direction.
Figure 14:
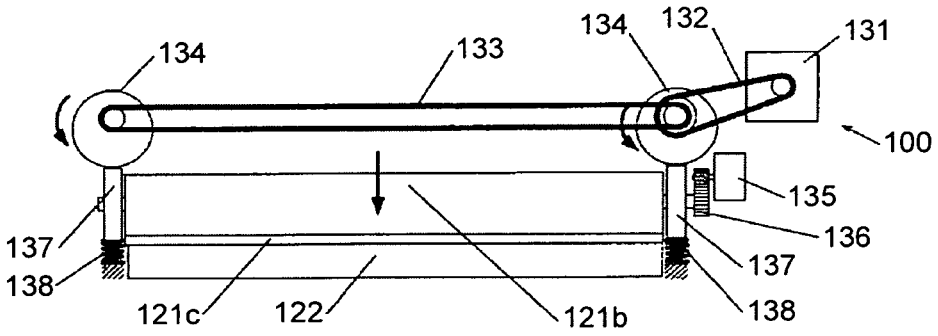
FIG. 14 is a diagram illustrating the configuration of the creasing device according to the first embodiment, the diagram being an elevation view illustrating a state in which the creasing device is performing creasing.
Figure 15:
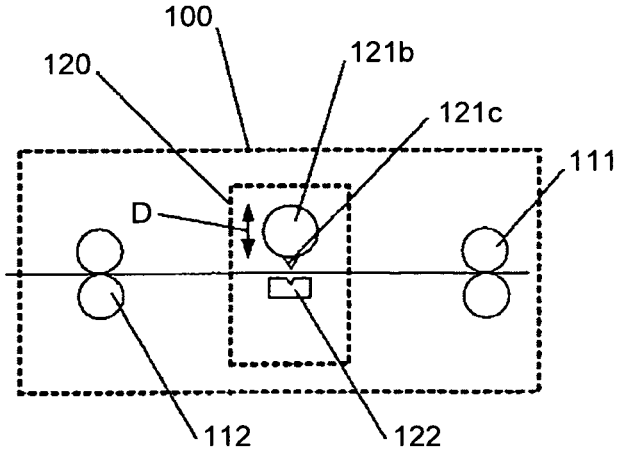
FIG. 15 is a simplified side view illustrating the states presented in FIGS. 13 and 14.

FIG. 13 to FIG. 15 are schematic diagrams illustrating the configuration of the creasing device 100 according to a first embodiment. FIG. 13 is an elevation view illustrating a standby state as viewed from the sheet conveying direction. FIG. 14 is an elevation view illustrating a state in which the creasing device 100 is performing creasing. FIG. 15 is a simplified side view illustrating the creasing device 100 in the states presented in FIGS. 13 and 14.

Referring to FIG. 13 to FIG. 15, the creasing device 100 includes the creasing blade unit 121*a*, which further includes a cylindrical first rotary member 121*b* and a creasing blade 121*c*. The first rotary member 121*b* and the creasing blade 121*c* are driven by a driving mechanism to rotate and reciprocate in one piece.

A reciprocating driving mechanism that drives the first rotary member 121*b* to reciprocate includes a first motor 131, a pulley speed-reduction mechanism 132, a driving belt 133, and a pair of cams 134. A rotational driving mechanism includes a second motor 135, a gear speed reduction mechanism 136, a pair of sliding members 137, and a pair of elastic urging members 138. The pulley speed-reduction mechanism 132 transmits driving power of the first motor 131 to the cams 134. The driving belt 133 transmits the driving power, which has been transmitted via the pulley speed-reduction mechanism 132 to one of the cams 134, to the other cam 134 so that the cams 134 arranged on two ends of the first rotary member 121*b* to rotate in one piece. The gear speed reduction mechanism 136 transmits driving power of the second motor 135 to the first rotary member 121*b*, thereby rotating the first rotary member 121*b*. The pair of disk-like sliding members 137 are coaxially arranged on the two ends of the first rotary member 121*b*. The elastic urging members 138, which are, for instance, compression springs, constantly urge the sliding members 137 elastically toward the cams 134.

FIG. 13 illustrates a state in which the first rotary member 121*b* is most distant from the receiving member 122, or, put another way, the distance between a rotation center of the cams 134 and surfaces of the sliding members 137 is at its minimum. FIG. 14 illustrates a state in which the creasing blade 121*c* of the first rotary member 121*b* is fitted into the creasing groove 122*c* of the receiving member 122 to some extent, or, put another way, the distance between the rotation center of the cams 134 and the surfaces of the sliding members 137 is close to its maximum.

The first rotary member 121*b*, the creasing blade 121*c*, the second motor 135, and the gear speed reduction mechanism 136 are movable in one piece up and down in FIGS. 13 and 14. The first rotary member 121*b* and the sliding members 137 rotate, in one piece, around an axis of rotation of the first rotary member 121*b*. The elastic urging members 138 bring the sliding members 137 into sliding contact with the cams 134. A path of contact between the cams 134 and the sliding members 137 limits a range of reciprocating motion of the first rotary member 121*b*.

The cams 134 are driven by the driving power of the first motor 131 transmitted via the pulley speed-reduction mechanism 132 and the driving belt 133. The cams 134 are configured such that rotation of the cams 134 causes the sliding members 137, the first rotary member 121*b*, the creasing blade 121*c*, the second motor 135, and the gear speed reduction mechanism 136 to move in one piece.

FIG. 15 is a diagram schematically illustrating how the first rotary member 121*b* and the receiving member 122 move toward and away from each other as illustrated in FIGS. 13 and 14. The receiving member 122 described above is positioned to face the creasing blade 121*c*. A sheet is creased by being pinched between the creasing blade 121*c* and the creasing groove 122*c* of the receiving member 122.

Figure 16:
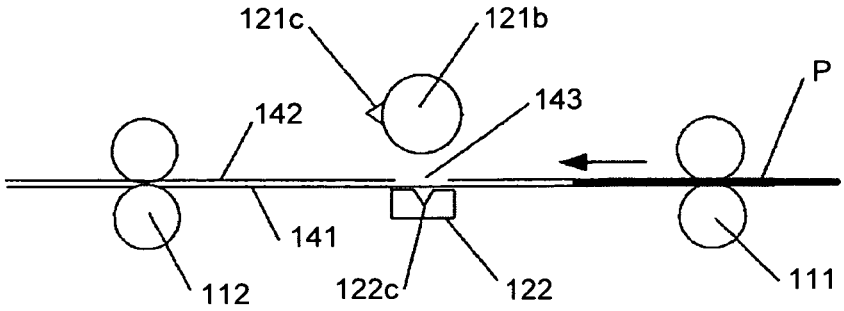
FIG. 16 is a schematic diagram illustrating a state in which sheet guiding has not been started yet according to the first embodiment.
Figure 17:
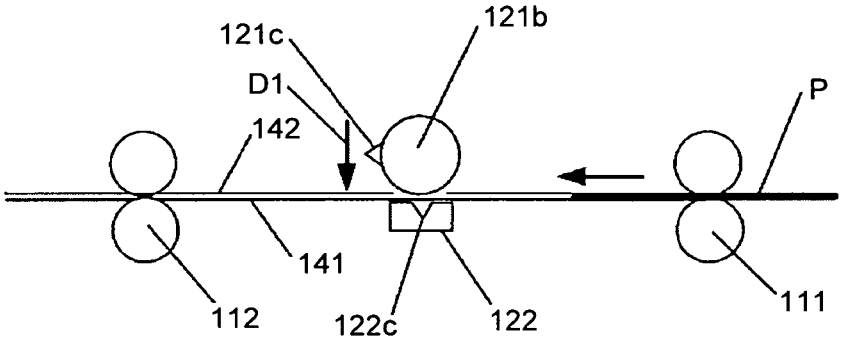
FIG. 17 is a schematic diagram illustrating a state in which sheet guiding is performed according to the first embodiment.

Generally, a sheet P is conveyed by being fed into a nip between guide members (guide plates) 141 and 142 that pinch and guide the sheet P and then receiving a conveying force from the first pair of conveying rollers 111 and the second pair of conveying rollers 112, as illustrated in FIG. 16. A notch 143 that allows passage of the creasing blade 121*c* should preferably be defined in the guide members 141 and 142 to crease the sheet by pinching the sheet between the creasing blade 121*c* and the creasing groove 122*c*. The first rotary member 121*b* should preferably be moved away from the notch 143 in the guide members 141 and 142 as illustrated in FIG. 16.

Figure 18:
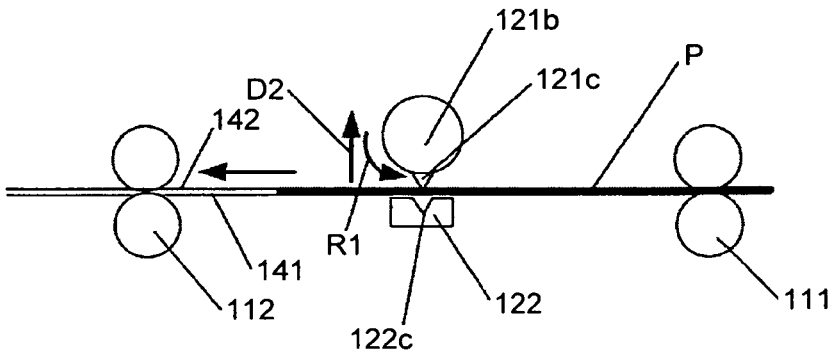
FIG. 18 is a schematic diagram illustrating a state immediately before the sheet is creased according to the first embodiment.
Figure 19:
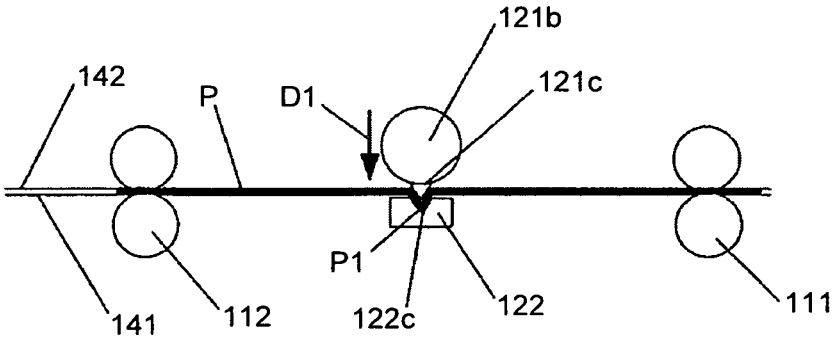
FIG. 19 is a schematic diagram illustrating a state in which the sheet is being creased according to the first embodiment.

However, a leading edge of a sheet can be caught by the notch 143 during conveyance of the sheet. To prevent such a situation, there is employed a configuration where a portion of the first rotary member 121*b* covers the notch 143 in the guide members 141 and 142 and, after the leading edge of the sheet passes over the notch 143, both the first rotary member 121*b* and the creasing blade 121*c* are retracted (in a direction indicated by an arrow D2) and further rotated (in a direction indicated by an arrow R1) as illustrated in FIG. 18, causing the creasing blade 121*c* to a point at the sheet P. When a to-be-creased position, at which the sheet P is to be creased, has reached immediately below the creasing blade 121*c*, the creasing blade 121*c* is lowered in a direction indicated by an arrow D1, as illustrated in FIG. 19, thereby pinching the sheet P between the creasing blade 121*c* and the receiving member 122 to form a crease P1.

Figure 20:
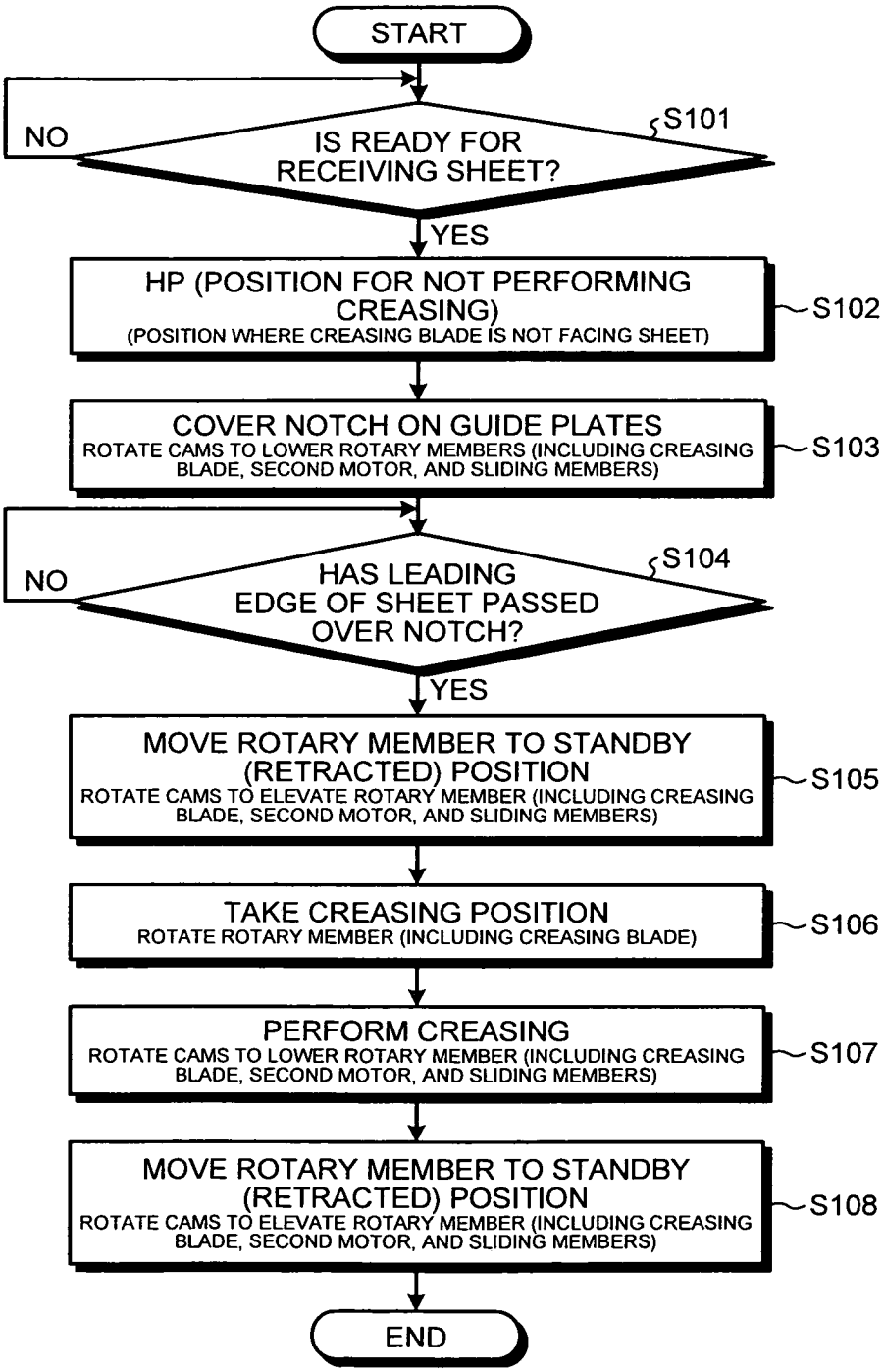
FIG. 20 is a flowchart of a process sequence according to the first embodiment.

FIG. 20 is a flowchart of a process sequence for these operations, or, put another way, a process sequence of the first embodiment. These operations are performed by a central processing unit (CPU) 100*a* of the creasing device 100, which will be described later with reference to an illustration in FIG. 37. The creasing device 100 carries out communications with the image forming apparatus PR and the folding device 200 to receive data about folding, data about sheet types, and the like and performs folding according to the data.

When the creasing device 100 is not arranged between the image forming apparatus PR and the folding device 200, the folding device 200 aligns edges of sheets conveyed from the image forming apparatus PR and folds the sheets without performing creasing, whereas when the creasing device 100 is arranged between the image forming apparatus PR and the folding device 200, the folding device 200 aligns edges of sheets that have been creased at a predetermined position by the creasing device 100 and folds the sheets.

Referring to the flowchart presented in FIG. 20, when the creasing device 100 and the folding device 200 are ready to receive a sheet (YES at step S101), the first rotary member 121*b* is moved from a preset home position (step S102), where the creasing blade 121*c* is not facing a sheet and therefore not performing creasing and away from the guide members 141 and 142, to the notch 143 in the guide members 141 and 142, thereby covering the notch 143 with a cylindrical side surface of the first rotary member 121*b* (step S103). The creasing blade 121*c*, the second motor 135; the gear speed reduction mechanism 136, and the sliding members 137 are also lowered in one piece with the first rotary member 121*b*. Meanwhile, when the first rotary member 121*b* is moved down or up, the creasing blade 121*c*, the second motor 135, the gear speed reduction mechanism 136, and the sliding members 137 (which are called, hereinafter, "accessory mechanism") are also moved down or up in one piece. In the present embodiment, for convenience, reference symbol D denotes vertical linear motion, while R denotes rotation and, furthermore, D1 is used to denote upward motion, while D2 is used to denote downward motion.

When the leading edge of the sheet has passed over the notch 143, there is no longer a possibility that the sheet leading edge is caught by the notch 143. Accordingly, the first rotary member 121*b* is moved to a standby (retracted) position (step S105). This motion to the standby position is performed by driving the first motor 131 to rotate the cams 134, thereby moving the first rotary member 121*b* and the accessory mechanism upward. Thereafter, the first rotary member 121*b* is rotated (spun) by the second motor 135 and the gear speed reduction mechanism 136 to cause the creasing blade 121*c* to face a top surface of the receiving member 122 or the creasing groove 122*c* that is formed on the top surface of the receiving member 122 (step S106). From the position of step S106, the first motor 131 drives to move the first rotary member 121*b* and the accessory mechanism downward and press the creasing blade 121*c* against the creasing groove 122*c* with the sheet P therebetween at a predetermined pressure (step S107). The predetermined pressure depends on a driving torque of the first motor 131 and a distance between the rotation center of the cams 134 and a contact position of the cams. After the crease P1 has been formed by this pressing motion, rotation of the first motor 131 is reversed to move the first rotary member 121*b* back to the standby position (step S108). Thereafter, the sheet is conveyed to the folding device 200. Hence, the sheet, in which the crease P1 has been formed at the position corresponding to the to-be-folded position, is delivered onto the center-folding tray 251 of the folding device 200 where the sheet undergoes folding.

Second Embodiment

In the first embodiment, a crease can be formed only from one side of a sheet. A second embodiment that allows a sheet to be creased from two sides of the sheet rather than only from one side is described below.

Figure 21:
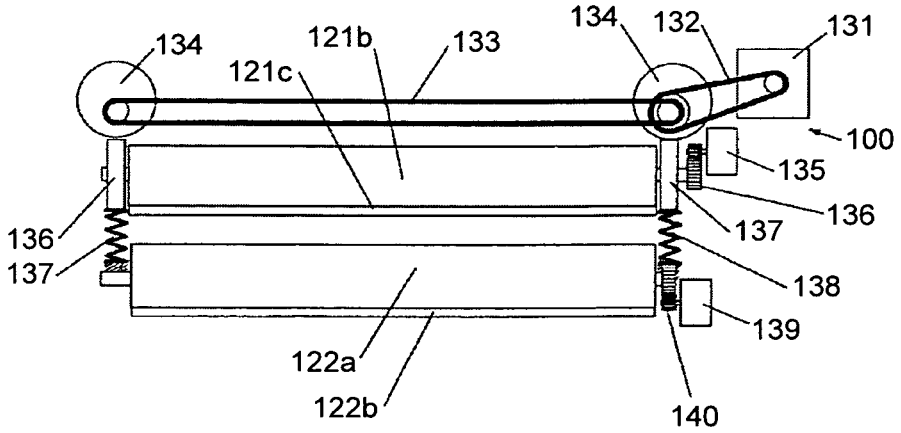
FIG. 21 is an elevation view illustrating the configuration of a creasing device according to a second embodiment.

FIG. 21 is a schematic diagram of an elevation view illustrating the configuration of the creasing device 100 according to the second embodiment as viewed from the sheet conveying direction. The creasing device 100 according to the second embodiment differs from the creasing device 100 according to the first embodiment illustrated in FIG. 13 in not including the receiving member 122 but including a second rotary member 122*a* that is rotatable as is the first rotary member 121*b*. The second rotary member 122*a* includes a creasing blade 122*b* and a creasing groove 122*c*. A creasing groove 121*d* is additionally cut in the first rotary member 121*b*. Each of the creasing blade 122*b* and the creasing groove 122*c* can be configured as a unit to be mounted on an outer boundary of a body of the second rotary member as will be described later.

Figure 22A:
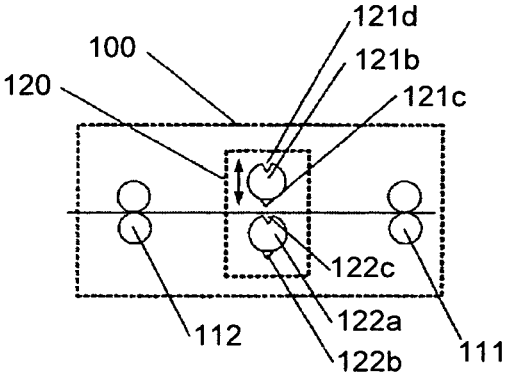
FIGS. 22A and 22B are simplified side views each illustrating positions of a rotary member, a receiving member, and a sheet according to the second embodiment.
Figure 22B:
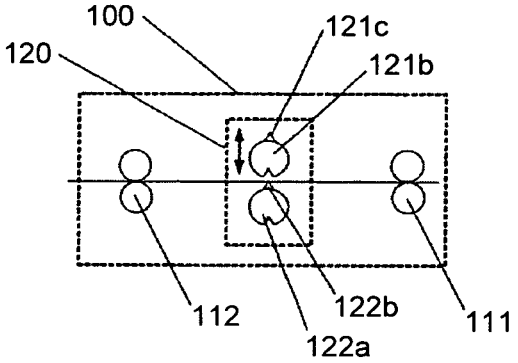

As is the first rotary member 121*b*, the second rotary member 122*a* is driven to rotate by driving power of a third motor 139 transmitted via a gear speed reduction mechanism 140 and controlled by the CPU 100*a* of the creasing device 100. As illustrated in FIGS. 22A and 22B, this allows for changing a relative position between the first rotary member 121*b* and the second rotary member 122*a* by being rotated separately. The first rotary member 121*b* reciprocates toward and away from the second rotary member 122*a* by actions of the first motor 131 and the cams 134. Hence, a crease can be formed between the first rotary member 121*b* and the second rotary member 122*a*.

A method of creasing according to the second embodiment is described below with additional reference to the flowchart presented in FIG. 30.

Figure 23:
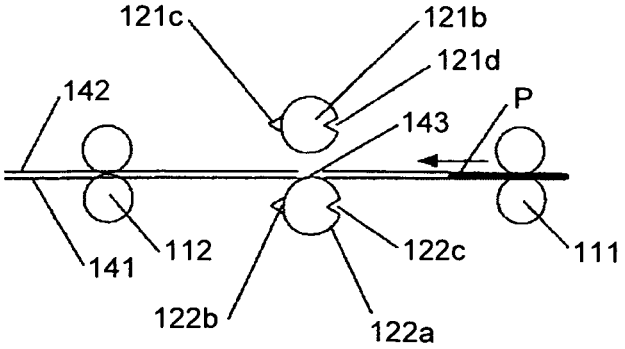
FIG. 23 is a schematic diagram illustrating a state in which sheet guiding has not been started yet according to the second embodiment.
Figure 24:
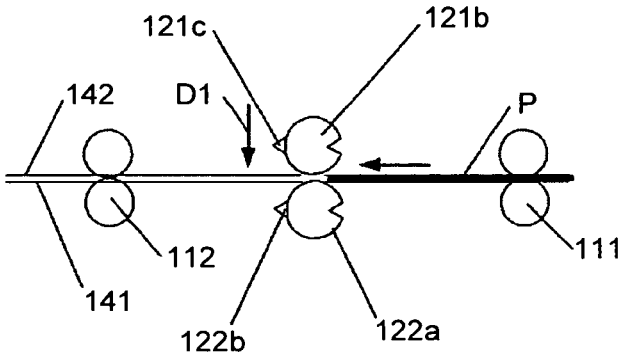
FIG. 24 is a schematic diagram illustrating a state in which sheet guiding is performed in the second embodiment.
Figure 30:
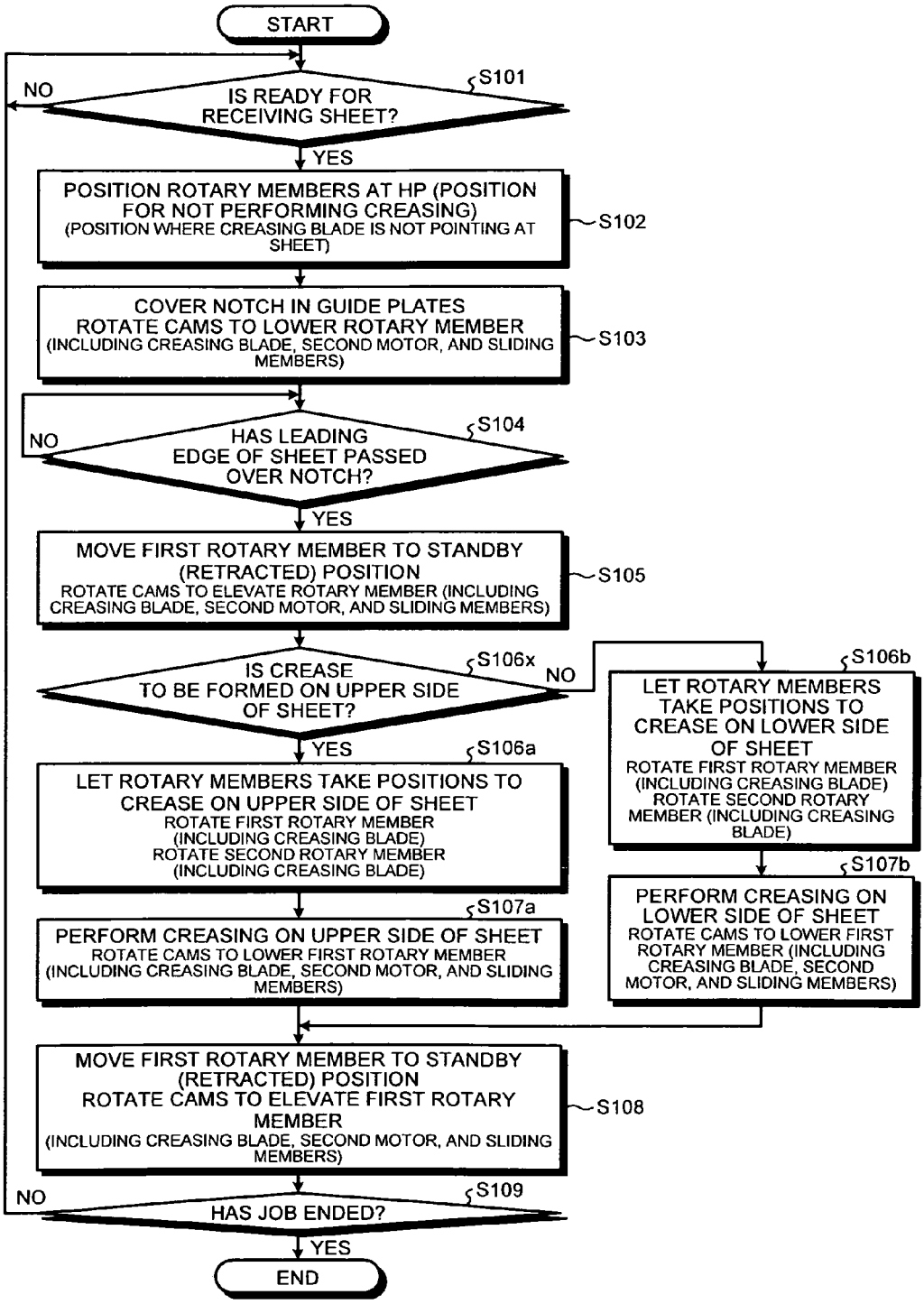
FIG. 30 is a flowchart illustrating a process sequence for creasing in the second embodiment.

Referring to FIG. 30, operations to be performed from step S101 to step S105 are similar to those of the first embodiment illustrated in FIG. 20. However, unlike the first embodiment, as illustrated in FIG. 23, the outer boundary of the second rotary member 122*a* is positioned at the notch 143 in the guide members 141 and 142 at step S103 and, in this state, the first rotary member 121*b* in the standby state is moved down to cover the notch 143 as illustrated in FIG. 24. This position, to which the first rotary member 121*b* is lowered to cover the notch 143, is set so as to leave a clearance above the notch 143 that allows passage of the sheet P.

Figure 25:
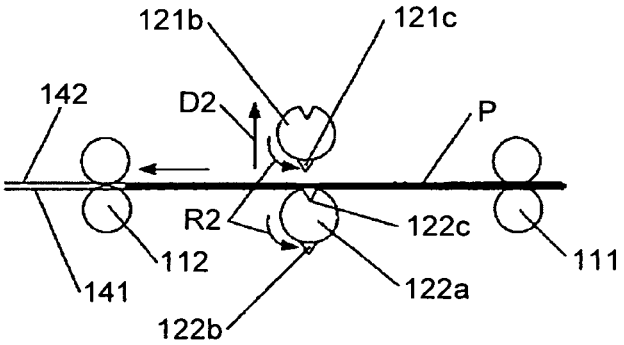
FIG. 25 is a schematic diagram illustrating a state immediately before the sheet is creased according to the second embodiment.
Figure 26:
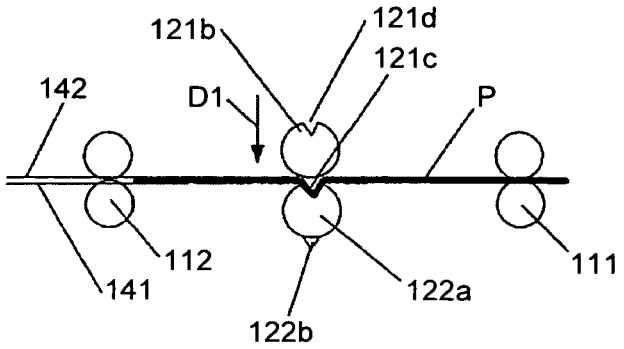
FIG. 26 is a schematic diagram illustrating a state in which the sheet is being creased in the second embodiment.
Figure 27:
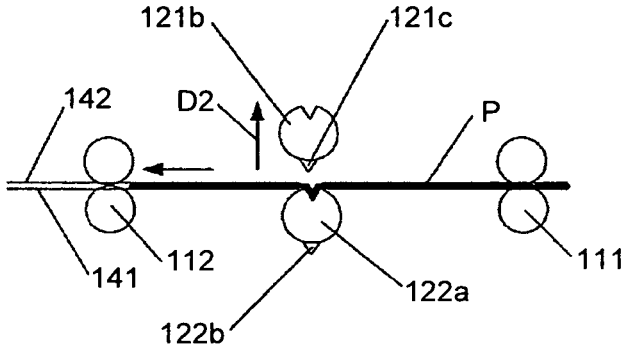
FIG. 27 is a schematic diagram illustrating a state in which, after creasing the sheet, the creasing device returns to the standby state according to the second embodiment.

After the leading edge of the sheet P passes over the notch 143 in the guide members 141 and 142 (YES at step S104), the first rotary member 121*b* is moved up to retract (step S105). Subsequently, determination as to which one of the two sides of the sheet a crease is to be formed on is made according to an instruction fed from the image forming apparatus PR side (step S106*x*). When it is determined that a crease is to be formed on an upper side (YES at step S106*x*), the first rotary member 121*b* and the second rotary member 122*a* are rotated concurrently (in a direction indicated by arrow R2 in FIG. 25), causing the creasing groove 122*c* to face the first rotary member 121*b* above to become ready for receiving the creasing blade 121*c* as illustrated in FIG. 25 (step S106*a*). In this state, the first rotary member 121*b* is moved down, causing the sheet P to be pinched between the creasing blade 121*c* and the creasing groove 122*c* of the second rotary member 122*a*, thereby forming the crease P1 (step S107*a*). After the crease P1 is formed, the first rotary member 121*b* returns to the standby position (step S108) (FIG. 27).

Figure 28:
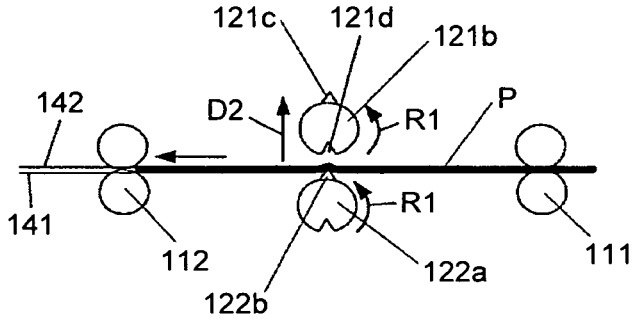
FIG. 28 is a schematic diagram illustrating a state immediately before the sheet is creased on another side according to the second embodiment.
Figure 29:
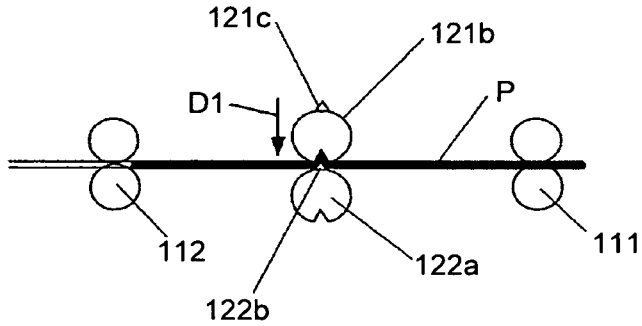
FIG. 29 is a schematic diagram illustrating a state in which the sheet is being creased on the other side according to the second embodiment.

In contrast, when it is determined that a crease is to be formed on the lower side of the sheet (NO at step S106*x*), the first rotary member 121*b* is moved up (in the direction indicated by arrow D2) from the state illustrated in FIG. 24, and the first and second rotary members 121*b* and 122*a* are rotated concurrently (in the direction indicated by arrow R1 in FIG. 28), causing the creasing groove 121*d* to face the second rotary member 122*a* below to be ready for receiving the creasing blade 121*c* as illustrated in FIG. 28 (step S106*b*). In this state, the first rotary member 121*b* is moved down, causing the sheet P to be pinched between the creasing groove 121*d* and the creasing blade 122*b* of the second rotary member 122*a*, thereby forming the crease P1 (step S107*b*).

This allows creases to be formed at different positions in different directions. After the crease P1 has been formed, the first rotary member 121*b* returns to the standby position (step S108) (FIG. 27). This series of operations is repeatedly performed (NO at step S109) until the job ends. On completion of the job (YES at step S109), the process sequence ends.

Third Embodiment

In the second embodiment, the two creasing blades, or, more specifically, the first creasing blade and the second creasing blade, are provided so that a crease can be formed on any one of the upper side and the lower side. A third embodiment is configured to form a crease on any one of the two sides of a sheet with a single creasing blade.

Figure 31:
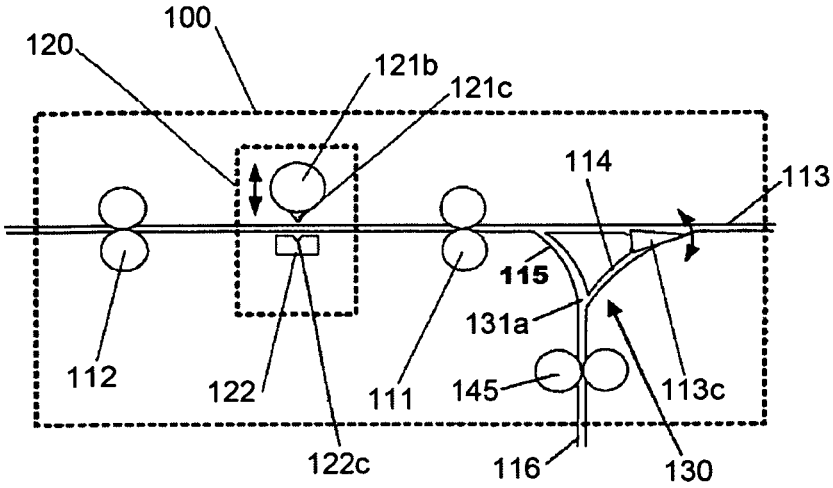
FIG. 31 is a diagram illustrating a schematic configuration of a creasing device according to a third embodiment.

FIG. 31 is a diagram illustrating a schematic configuration of the creasing device 100 according to the third embodiment. Referring to FIG. 31, the creasing device 100 according to the third embodiment differs from the creasing device 100 according to the first embodiment in additionally including a sheet reversing mechanism 130. The first pair of conveying rollers 111 is arranged in an upstream side of the creasing device 100 in the conveying direction, and the sheet reversing mechanism 130 is arranged in a further upstream side to the first pair of conveying rollers 111 in the conveying direction. The sheet reversing mechanism 130 includes a branch conveying path 114 bifurcated from an entrance conveying path 113 at a position between an entrance of the entrance conveying path 113 and the first pair of conveying rollers 111, a merging conveying path 115 for conveying a sheet, which has been turned over via the branch conveying path 114, back onto the entrance conveying path 113, a path-switching flap 113*c* provided at a bifurcation unit where bifurcation into the entrance conveying path 113 and the branch conveying path 114 is made, and conveying rollers 145 for conveying a sheet in a switchback manner on the branch conveying path 114.

Figure 32:
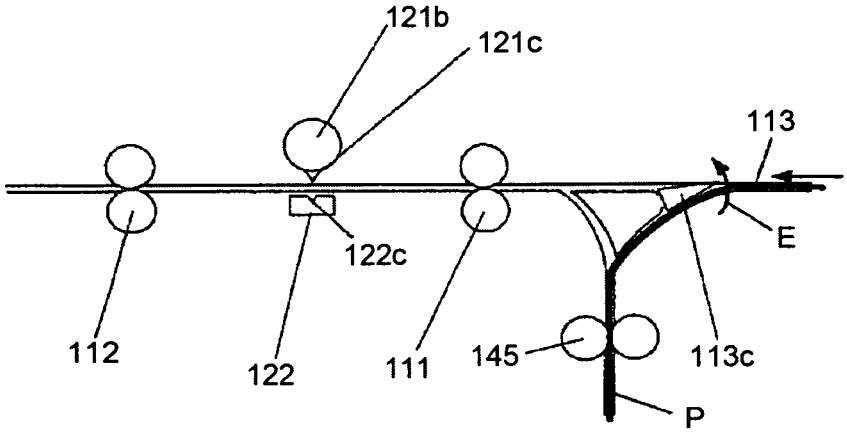
FIG. 32 is a schematic diagram illustrating a state in which the sheet is conveyed into a reverse conveying path according to the third embodiment.
Figure 33:
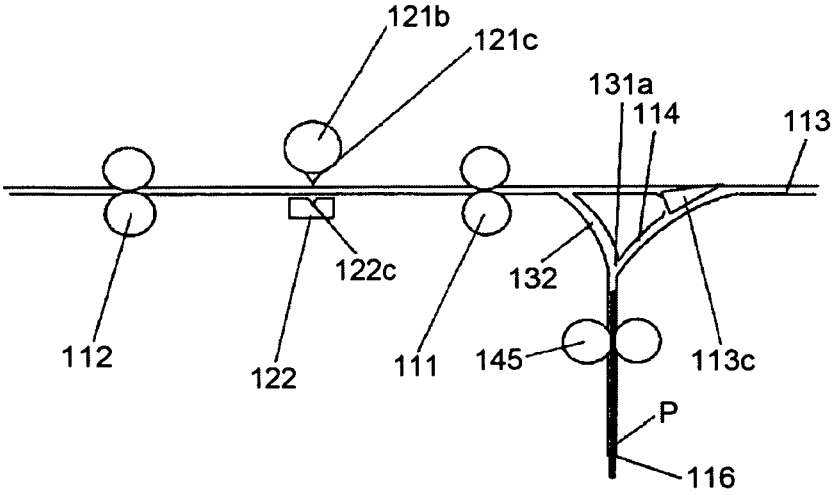
FIG. 33 is a schematic diagram illustrating a state in which the sheet has been conveyed into the reverse conveying path and immediately before reversing a conveying direction according to the third embodiment.
Figure 34:
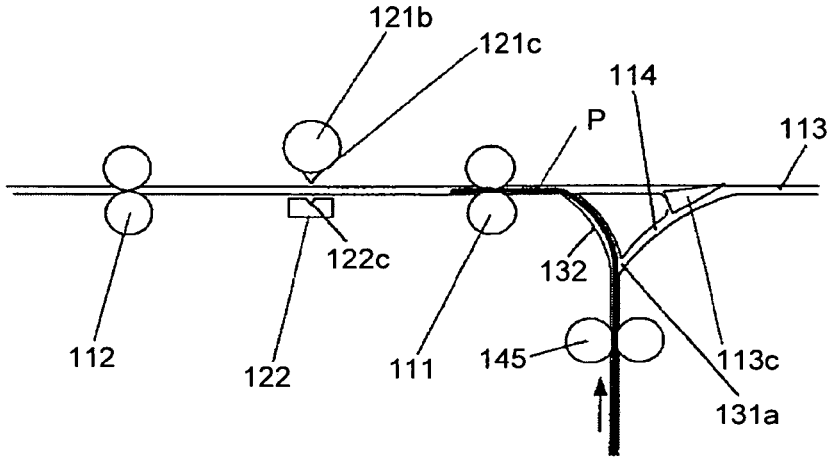
FIG. 34 is a schematic diagram illustrating a state in which the sheet has been conveyed out of the reverse conveying path and into the creasing mechanism by reversing the conveying direction according to the third embodiment.

By using the sheet reversing mechanism 130, a crease can be formed in a sheet that has been turned over. FIG. 32 to FIG. 34 are schematic diagrams illustrating sheet reversing. As illustrated in FIG. 32, when the path-switching flap 113*c* rotates counterclockwise (in a direction indicated by arrow E) to connect a path to the branch conveying path 114 and shuts off a path for direct conveyance from the entrance conveying path 113 to the first pair of conveying rollers 111, the sheet P conveyed on the entrance conveying path 113 is guided to the branch conveying path 114 and conveyed downward by the conveying rollers 145 to a reverse conveying path 116. As illustrated in FIG. 33, when a trailing edge of the sheet has passed through a bifurcation unit 131*a* where bifurcation into the branch conveying path 114 of the reverse conveying path 116 and the merging conveying path 115 is made, the conveying rollers are rotated in a reversal direction, thereby conveying the sheet P upward. This causes, as illustrated in FIG. 34, the sheet to be delivered along a branch shape of the bifurcation unit 131*a* onto the merging conveying path 115 to return to the entrance conveying path 113, on which the sheet is delivered to the first pair of conveying rollers 111.

The first pair of conveying rollers 111 receives the sheet P, which has been turned over in passing through the reverse conveying path 116, and delivers the sheet to the creasing mechanism 120. The creasing mechanism 120 creases the sheet P as described above with reference to FIGS. 15 to 19.

This configuration allows, even when the creasing mechanism 120 is capable of forming a crease only from one side of a sheet, a crease to be formed on any one of the two sides of the sheet by turning over the sheet.

Meanwhile, elements that are not specifically described in the third embodiment have similar configurations and functions to those of the first embodiment.

Fourth Embodiment

A crease can be formed on one side of a sheet in a selective manner; this can be attained by, for instance, providing conveying paths above and below a creasing mechanism and conveying a sheet to be creased to one of the conveying paths. A fourth embodiment is configured as such. In the fourth embodiment, a conveying path, in which a bottom surface of the sheet faces a creasing blade, and a conveying path, of which a top surface of the sheet faces a creasing blade, are provided. Bifurcation into the two conveying paths is made at a bifurcation point in an upstream side along the sheet conveying direction. A path-switching flap for selecting one of the conveying paths, at which creasing is to be performed, is provided at the bifurcation point.

Figure 35:
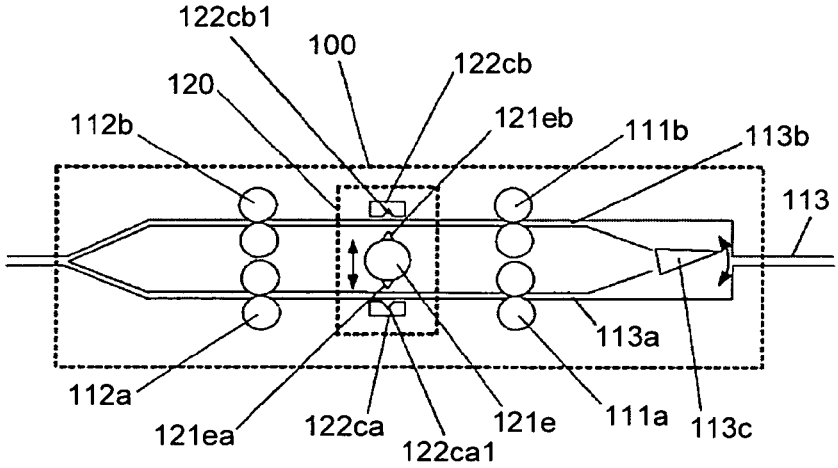
FIG. 35 is a diagram illustrating a schematic configuration of a creasing device according to a fourth embodiment.

FIG. 35 is a schematic diagram illustrating the configuration of the creasing device 100 according to the fourth embodiment. Referring to FIG. 35, the entrance conveying path 113 is vertically bifurcated by a path-switching flap 113*c* into a first-branch conveying path 113*a* and a second-branch conveying path 113*b*, which are merged together at a merging point in a downstream side along the sheet conveying direction. The creasing mechanism 120 is provided between a bifurcation point and the merging point of the first- and second-branch conveying paths 113*a* and 113*b*. First pairs of conveying rollers 111*a* and 111*b* are provided in an upstream side of the creasing mechanism 120 on the first and second-branch conveying paths 113*a* and 113*b* along the sheet conveying direction while second pairs of conveying rollers 112*a* and 112*b* are provided in a downstream side of the creasing mechanism 120 along the sheet conveying direction.

The creasing mechanism 120 includes a first creasing blade 121*ea* on a top side of a creasing member 121*e* and a second creasing blade 121*eb* on a bottom side of the creasing member 121*e*. The creasing mechanism 120 further includes a first receiving member 122*ca* in which a first creasing groove 122*ca*1 is cut and a second receiving member 122*cb* in which a second creasing groove 122*cb*1 is cut. The first creasing blade 121*ea* faces the first receiving member 122*ca* by interposing the first-branch conveying path 113*a* in between, and the second creasing blade 121*eb* faces the second creasing groove 122*cb*1 by interposing the second-branch conveying path 113*b*. The first and second creasing grooves 122*ca*1 and 122*cb*1 and the first and second creasing blades 121*ea* and 121*eb* are arranged on a line and configured to move vertically from a standby position illustrated in FIG. 35 as indicated by arrows. It is therefore possible either that the first creasing blade 121*ea* is fitted into the first creasing groove 122*ca*1 by interposing a sheet in between or that the second creasing blade 121*eb* is fitted into the second creasing groove 122*cb*1 by interposing a sheet in between.

A driving mechanism for the creasing member 121*e* is not specifically described. For instance, such a mechanism as that mentioned in the first embodiment that allows vertical movement can be employed.

Figure 36:
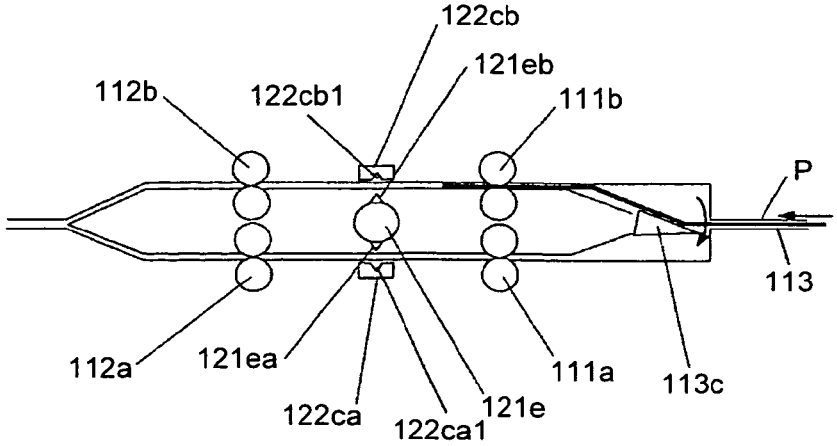
FIG. 36 is a schematic diagram illustrating how a crease is formed in the sheet according to the fourth embodiment.

When the entrance conveying path 113 and the creasing mechanism 120 are configured as described above, a crease can be formed on a lower side of the sheet as follows. As presented in FIG. 36, which is the schematic diagram illustrating the operations, the path-switching flap 113*c* is directed downward to guide the sheet P to the second-branch conveying path 113*b*, which is an upper branch of the vertically bifurcated conveying path. The sheet P is conveyed by the first pair of conveying rollers 111*b* in the second-branch conveying path 113*b* to a creasing position. When the sheet P has reached the creasing position, the creasing member 121*e* is moved up, causing the second creasing blade 121*eb* to be fitted into the second creasing groove 122*cb*1 with the sheet P therebetween. Hence, a crease is formed on the lower side of the sheet P.

A crease can be formed on an upper side of the sheet P as follows. The path-switching flap 113*c* is switched to direct upward to guide the sheet P to the first-branch conveying path 113*a*, which is a lower branch of the vertically bifurcated conveying path. The creasing member 121*e* is moved down at the creasing position to form a crease on the upper side of the sheet P.

The configuration described above allows a crease to be formed on any one of the two sides of the sheet only by switching between the first- and second-branch conveying paths 113*a* and 113*b* that are arranged next to the entrance conveying paths 113.

Meanwhile, elements that are not specifically described in the fourth embodiment have similar configurations and functions to those of the first embodiment.

Figure 37:
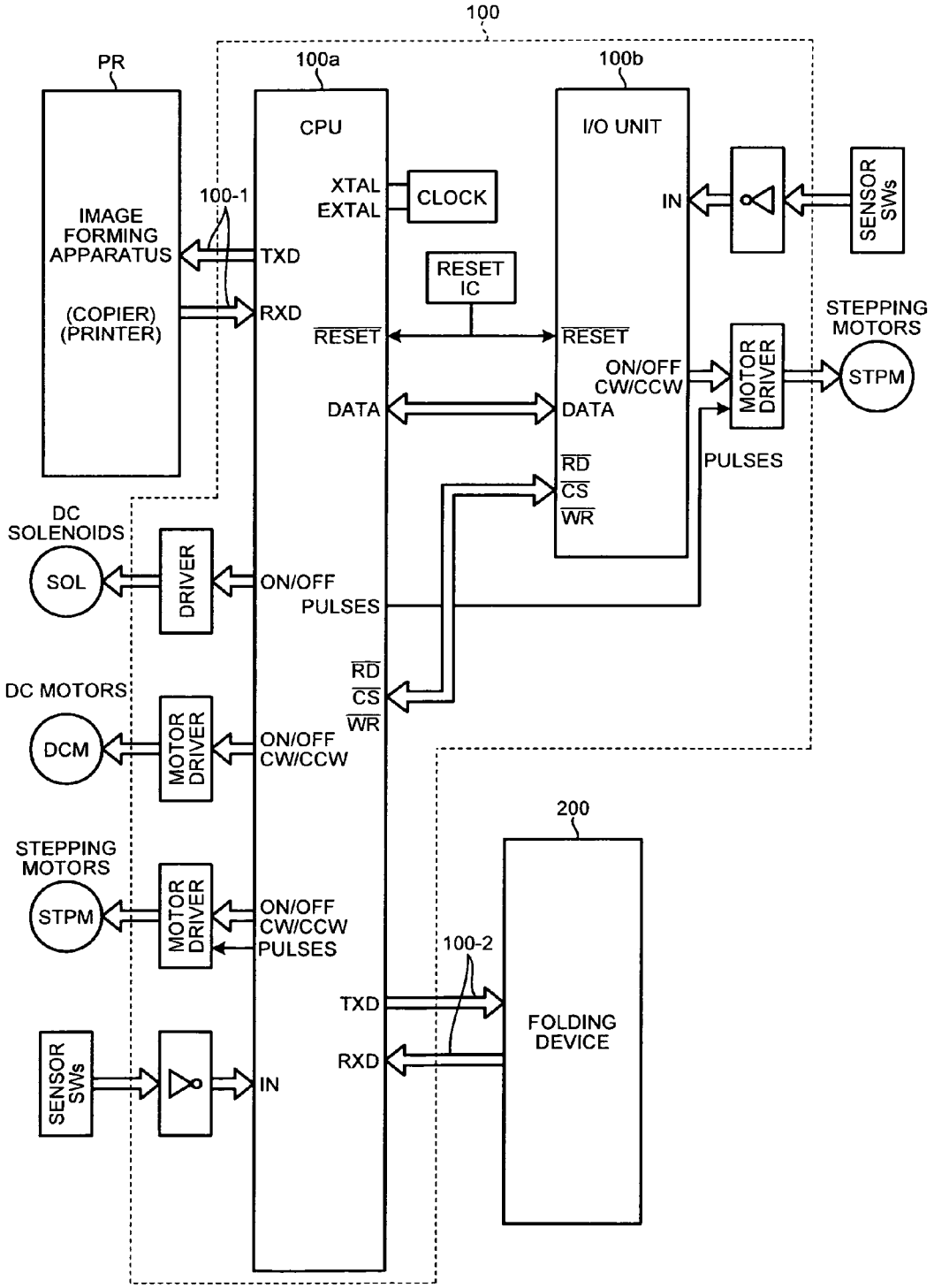
FIG. 37 is a block diagram illustrating a schematic configuration of the image forming system according to the present embodiment including the first to fourth embodiments.

FIG. 37 is a block diagram illustrating an electrical configuration (control configuration) of the image forming system according to the present embodiment including the first to fourth embodiments.

Referring to FIG. 37, the image forming system according to the present embodiment includes the creasing device 100, the folding device 200 that performs folding, and the image forming apparatus PR. The creasing device 100 and the image forming apparatus PR are connected via a communication interface 100-1, via which information about sheets, a post-processing mode, an anomaly, and the like are notified. Similarly, the creasing device 100 and the folding device 200 that performs folding are connected via a communication interface 100-2.

The creasing device 100 includes the CPU 100*a* that controls the entire creasing device and its various units and an input-output (I/O) unit 100*b* that manages inputs and outputs between the CPU 100*a*, and various sensors and drivers that drive solenoids, motors, and the like. The CPU 100*a* performs control operations by reading program codes stored in a read only memory (ROM) (not shown), storing the program codes into a random access memory (RAM) (not shown), and executing program instructions defined in the program codes by using the RAM as a working area and a data buffer.

Figure 39:
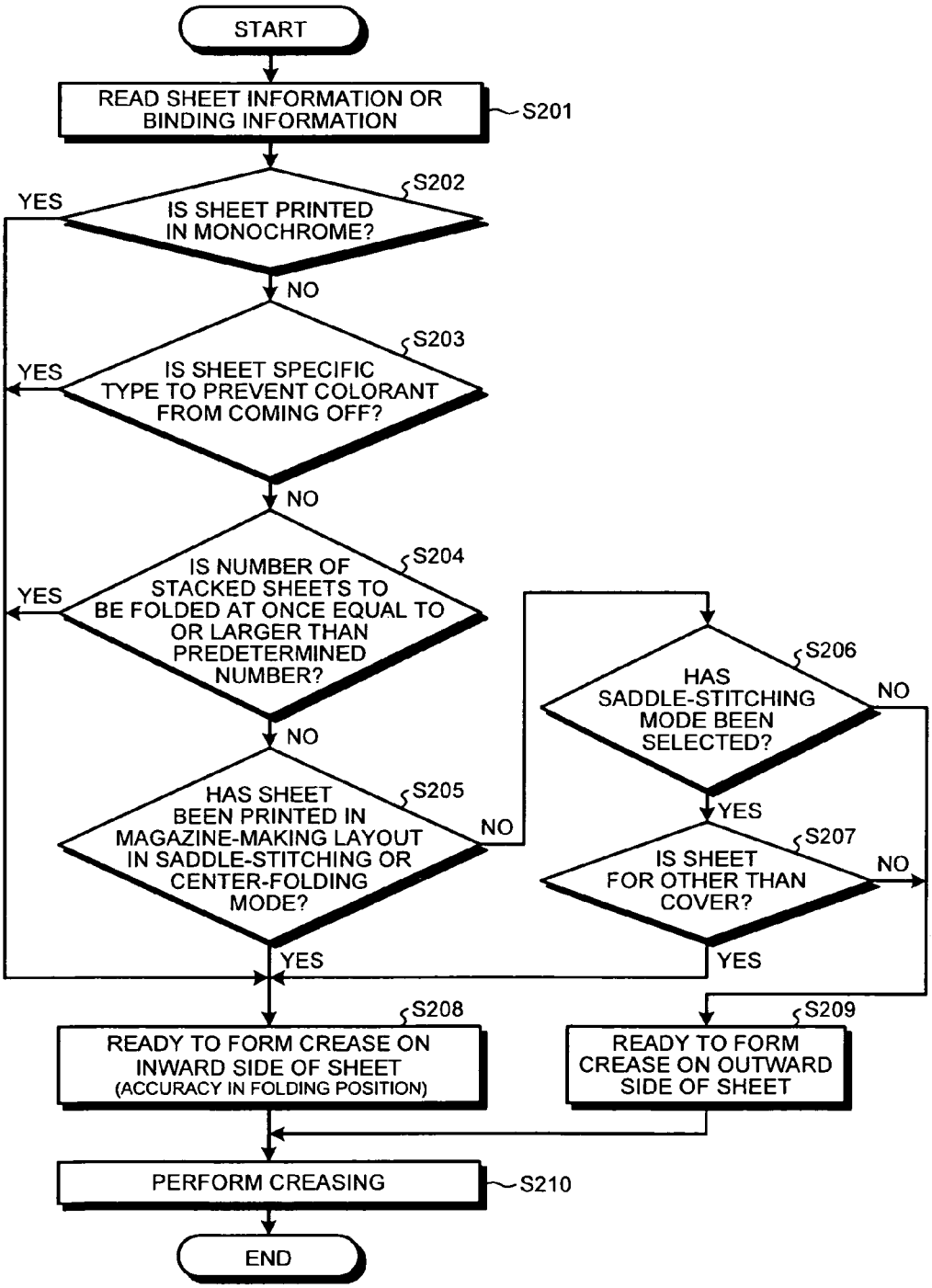
FIG. 39 is a flowchart, according to the embodiment, of a process sequence for determining a surface on which a crease is to be formed.

In the present embodiment, a crease can be formed in a selected side of the two surfaces of the sheet P. FIG. 39 is a flowchart of a process sequence for determining a surface, in which a crease is to be formed.

Referring to FIG. 39, when sheet information or binding information is notified from the image forming apparatus PR to the creasing device 100 via the communication interface 100-1, the CPU 100*a* of the creasing device 100 reads the sheet information or the binding information that are notified from the image forming apparatus PR (step S201) and determines whether or not monochrome printing has been performed (step S202). In a case that monochrome printing has been performed, because coming off of colorant does not occur, it is determined that a crease is to be formed on an inward side of the sheet P to keep high accuracy in determining a folding position (step S208). Creasing is performed accordingly (step S210).

If it is determined that monochrome printing has not been performed (NO at step S202), a determination is made as to whether or not a specific type of sheet is used to prevent colorant from coming off (step S203). If it is determined that the specific type of sheet is used to prevent the colorant from coming off, process control proceeds to step S208, and operations pertaining to step S208 and step S210 are performed.

If it is determined that the specific type of sheet is not used to prevent the colorant from coming off, a determination is made as to whether or not the number of stacked sheets to be folded at once is equal to or larger than a predetermined number (step S204). If the number of stacked sheets to be folded at once is equal to or larger than the predetermined number, or, put another way, when the number of the stacked sheets is equal to or larger than the predetermined number that makes an angle of a fold of the stacked sheets large enough not to cause coming off of colorant, process control proceeds to step S208, and operations pertaining to step S208 and step S210 are performed.

Figure 38A:
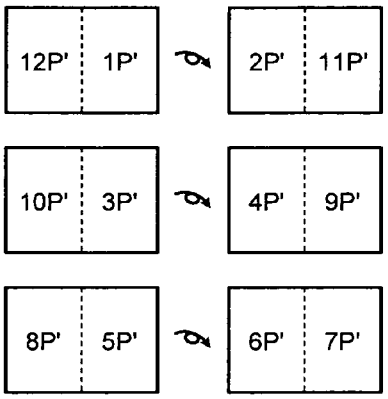
FIGS. 38A and 38B are explanatory diagrams illustrating a specific example of a magazine-making layout.
Figure 38B:
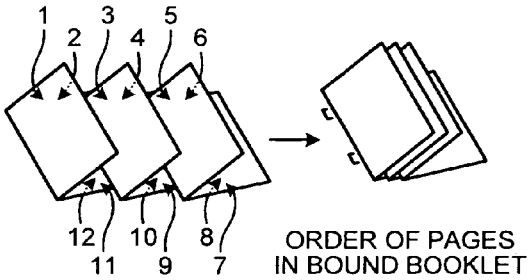

If it is determined that the number of sheets is fewer than the predetermined number, a determination is made as to whether or not the sheet has been printed in a magazine-making layout in any one of a saddle-stitching mode and a center-folding mode (step S205). Coming off of colorant does not occur from a sheet that is printed in the magazine-making layout in the saddle-stitching mode or the center-folding mode because no image is formed at a to-be-center-folded portion of the sheet. Accordingly, if it is determined that the sheet has been printed in the magazine-making layout, process control proceeds to step S208 and operations pertaining to step S208 and step S210 are performed. The magazine-making layout is described below with reference to FIG. 38A by way of an example of making a 12-page booklet by using three sheets. On one side of a first sheet of the three sheets, 12P' (P' denotes a page number) and 1P' are printed, while 2P' and 11P' are printed on the other side of the first sheet; on one side of a second sheet, 10P' and 3P' are printed, while 4P' and 9P' are printed on the other side of the second sheet; on one side of a third sheet, 8P' and 5P' are printed, while 6P' and 7P' are printed on the other side of the third sheet. The three sheets are overlaid one after another, saddle stitched, and folded (center-folded) as illustrated in FIG. 38B.

If it is determined that the sheet has not been printed in the magazine-making layout (NO at step S205), a determination is made as to whether or not the saddle-stitching mode has been selected (step S206). If it is determined that saddle-stitching mode has been selected (YES at step S206), a determination is made as to whether or not the sheet to be creased is for a cover (step S207). If it is determined that the sheet is not for the cover, process control proceeds to step S208, and operations pertaining to step S208 and step S210 are performed. When the sheet not for the cover (i.e., the sheet, for which a result of determination made at step S207 is YES) is saddle-stitched, a to-be-folded portion of the sheet is hidden; therefore, coming off of colorant at the to-be-folded portion does not pose a problem, and accordingly, the crease is to be formed on the inward side of the sheet. In the example illustrated in FIGS. 38A and 38B, a sheet to be a cover corresponds to the first sheet having pages numbered 1P', 2P', 11P' and 12P'.

In contrast, if it is determined that saddle-stitching mode has not been selected (NO at step S206) and it is determined that the sheet is for a cover (YES at step S207), colorant may come off. In such a case, it is determined that the crease is to be formed on the outward side (step S209) and creasing is performed accordingly (step S210).

A side, from which a crease is to be formed, is selected in this way. Accordingly, for a sheet, on which image quality should preferably be maintained, an outward side is selected as the side where a crease is to be formed at step S209, while for a sheet, on which higher importance should preferably be placed on accuracy in a folding position rather than on image quality, an inward side is selected as the side on which a crease is to be formed at step S208. By selecting any one of the outward side and the inward side in this way, both maintaining image quality and high accuracy in a folding position can be satisfied.

According to an aspect of the present invention, a surface, on which a crease is to be formed, of a sheet is determined based on sheet information or binding information, and creasing is performed according to a result of the determination. This allows both maintaining image quality and high accuracy in a folding position to be satisfied while paying attention to both preventing colorant from coming off and keeping accuracy in positioning.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device to form a crease in a to-be-folded portion of a sheet, the creasing device comprising:

a sheet-information reading unit to read any one of sheet information and binding information;

a determining unit to determine a surface, on which the crease is to be formed, of the sheet according to the one of the sheet information and the binding information read by the sheet-information reading unit; and a creasing unit to form the crease on the surface determined by the determining unit;

wherein the sheet information includes information indicating at least one of whether the sheet is monochrome, whether the sheet is specific to prevent colorant from coming off, and whether a number of stacked sheets to be folded at once is equal to or larger than a threshold number.

2. The creasing device according to claim 1, wherein the creasing unit is provided on each of an upper side and a lower side of a sheet conveying path to interpose the sheet conveying path therebetween, and one creasing unit of the creasing units, which faces the surface determined by the determining unit, configured to form the crease on the surface.

3. The creasing device according to claim 2, wherein the creasing units include:

first and second rotary members rotatable and movable in a reciprocating manner in a direction along the sheet, the first and second rotary members being arranged in a direction perpendicular to a sheet conveying direction to interpose the sheet conveying path therebetween;

first and second creasing members respectively provided on surfaces of the first and second rotary members and extend parallel to axes of rotation of the first and second rotary members;

first and second creasing grooves respectively formed on the surfaces of the first and second rotary members and extend parallel to the axes of rotation of the first and second rotary members, the first and second creasing grooves being configured to fit the first and second creasing members, respectively;

a rotary drive unit configured to rotate the first and second rotary members and stop the first and second rotary members at a desired angle; and a reciprocating drive unit to bring the first and second creasing members into press contact with each other via the sheet on the sheet conveying path and move the first and second creasing members away from the sheet in a state that the first rotary member is placed in a resting state by the rotary drive unit and faces the second creasing groove of the second rotary member.

4. The creasing device according to claim 1, wherein the creasing unit includes:

a rotary member rotatable and movable in a reciprocating manner in a direction along the sheet, the rotary member being arranged in a direction perpendicular to a sheet conveying direction;

a creasing member provided on a surface of the rotary member and extending parallel to an axis of rotation of the rotary member;

a receiving member provided at a position to face the rotary member with the sheet interposed therebetween;

a rotary drive unit configured to rotate the rotary member and stop the rotary member at a desired angle; and a reciprocating drive unit to bring the rotary member, which is placed in a resting state, into press contact by the rotary drive unit with the receiving member via the sheet and move the rotary member away from the sheet, and wherein the creasing device further includes a reversing mechanism to turn over the sheet and is provided in an upstream side of the creasing unit in the sheet conveying direction.

5. The creasing device according to claim 1, wherein the creasing unit includes:

a rotary member rotatable and movable in a reciprocating manner in a direction along the sheet, the rotary member being arranged to face both of bifurcated conveying paths and extending in a direction perpendicular to a sheet conveying direction;

a pair of creasing members provided on a surface of the rotary member to have a 180-degree rotational symmetry, and extend parallel to an axis of rotation of the rotary member;

a pair of receiving members provided at positions to face the rotary member with the two sheet conveying paths interposed therebetween;

a rotary drive unit configured to rotate the rotary member and stop the rotary member at a desired angle; and a reciprocating drive unit to bring the rotary member, which is placed in a resting state, into press contact by the rotary drive unit with the receiving member facing a selected one of the two sheet conveying paths via the sheet, and move the rotary member away from the sheet.

6. The creasing device according to claim 1, wherein when the sheet has been printed in monochrome, the determining unit determines, as the surface on which the crease is to be formed, a surface of the sheet that is to be an inward side in folding the sheet.

7. The creasing device according to claim 1, wherein when the sheet is of a paper type, which prevents colorant from coming off the sheet, the determining unit determines, as the surface on which the crease is to be formed, a surface of the sheet that is to be an inward side in folding the sheet.

8. The creasing device according to claim 1, wherein when a number of stacked sheets to be folded at once is equal to or larger than a threshold number that makes an angle of a fold of the stacked sheets large enough not to cause colorant to come off the sheet, the determining unit determines, as the surface on which the crease is to be formed, a surface of the sheet that is to be an inward side in folding the sheet.

9. The creasing device according to claim 1, wherein when the sheet has been printed in a magazine-making layout in any one of a saddle-stitching mode and a center-folding mode, the determining unit determines, as the surface on which the crease is to be formed, a surface of the sheet that is to be an inward side in folding the sheet.

10. The creasing device according to claim 1, wherein when a saddle-stitching mode has been selected and, when the sheet is for use as a cover, the determining unit determines, as the surface on which the crease is to be formed, a surface of the sheet that is to be an outward side in folding the sheet, whereas when the sheet is not for use as a cover, the determining unit determines, as the surface on which the crease is to be formed, a surface of the sheet that is to be an inward side in folding the sheet.

11. An image forming system comprising:

a creasing device to form a crease in a to-be-folded portion of a sheet;

a sheet-information reading unit to read any one of sheet information and binding information;

a determining unit to determine a surface, on which the crease is to be formed, of the sheet according to the one of the sheet information and the binding information read by the sheet-information reading unit; and a creasing unit to form the crease on the surface determined by the determining unit; wherein the sheet information includes information indicating at least one of whether the sheet is monochrome, whether the sheet is specific to prevent colorant from coming off, and whether a number of stacked sheets to be folded at once is equal to or larger than a threshold number.

12. A creasing method for forming a crease in a to-be-folded portion of a sheet, the creasing method comprising:

reading any one of sheet information and binding information;

determining a sheet surface, on which the crease is to be formed, according to the one of the sheet information and the binding information read at the reading; and forming the crease on the surface determined at the determining;

wherein the sheet information includes information indicating at least one of whether the sheet is monochrome, whether the sheet is specific to prevent colorant from coming off, and whether a number of stacked sheets to be folded at once is equal to or larger than a threshold number.

* * * * *